US012735963B1

(12) United States Patent
Brown

(10) Patent No.: US 12,735,963 B1
(45) Date of Patent: Sep. 15, 2026

(54) GAS LIFT VALVE HAVING RATCHETING ORIFICE

(71) Applicant: Weatherford Technology Holdings, LLC, Houston, TX (US)

(72) Inventor: Donavan H. Brown, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 19/089,232

(22) Filed: Mar. 25, 2025

Related U.S. Application Data

(60) Provisional application No. 63/772,523, filed on Mar. 15, 2025.

(51) Int. Cl.
*E21B 43/12* (2006.01)

(52) U.S. Cl.
CPC ..... *E21B 43/123* (2013.01); *Y10T 137/2934* (2015.04)

(58) Field of Classification Search
CPC .. E21B 43/123; E21B 2200/03; E21B 23/006; Y10T 137/2934
See application file for complete search history.

(56) References Cited

U.S. PATENT DOCUMENTS 3,143,128 A * 8/1964 Bicking, Jr. ..... E21B 43/123 137/155
3,318,322 A * 5/1967 Garrett ..... E21B 43/123 137/155
5,535,767 A * 7/1996 Schnatzmeyer ..... E21B 34/102 137/155
5,971,004 A * 10/1999 Pringle ..... E21B 34/066 137/155
5,979,553 A * 11/1999 Brink ..... E21B 47/00 166/321
6,148,843 A * 11/2000 Pringle ..... E21B 43/123 137/155
6,491,105 B2 * 12/2002 Holt, Jr. ..... E21B 43/123 166/321

(Continued)

FOREIGN PATENT DOCUMENTS

CA 2235022 A1 2/1999
EP 0732479 A2 9/1996
GB 2239472 A * 7/1991 ..... E21B 43/1235

OTHER PUBLICATIONS

Int'l Search Report and Written Opinion in PCT/US2026/011713, mailed Apr. 30, 2026, 11 pgs.

*Primary Examiner* — David Colon-Morales
(74) *Attorney, Agent, or Firm* — Cabello Hall Zinda, PLLC

(57) ABSTRACT

A gas lift valve is opened and closed by subjecting a pressure-sensitive piston to pressure differentials between annulus and tubing pressures. The piston can be held in (and released from) a closed position by rotatably indexing an indexing assembly in incremental rotations on the piston when in the closed position. The indexing assembly is rotated when the piston is alternatingly moved in opposing axial directions when the pressure differential is alternated. In response to those incremental rotations, an outer ratchet on the piston can be alternately expanded and contracted. When expanded, the outer ratchet engages a ratchet profile in the gas lift valve to prevent the piston from moving open. When the outer ratchet is contracted, however, the piston can be moved open.

20 Claims, 15 Drawing Sheets

(56) References Cited

U.S. PATENT DOCUMENTS

| | | | | |
|---|---|---|---|---|
| 6,932,581 | B2 * | 8/2005 | Messick | E21B 43/123 417/112 |
| 7,370,706 | B2 * | 5/2008 | Becker | E21B 43/123 137/155 |
| 7,556,102 | B2 | 7/2009 | Gomez | |
| 8,162,060 | B2 * | 4/2012 | Randazzo | E21B 43/123 166/321 |
| 8,267,178 | B1 | 9/2012 | Sommers et al. | |
| 8,887,811 | B2 | 11/2014 | Hofman et al. | |
| 8,915,300 | B2 | 12/2014 | Sommers et al. | |
| 9,010,353 | B2 * | 4/2015 | Salihbegovic | E21B 43/123 166/372 |
| 9,057,255 | B2 * | 6/2015 | Juenke | E21B 43/123 |
| 9,464,506 | B2 | 10/2016 | Coon et al. | |
| 9,574,414 | B2 | 2/2017 | Arabsky et al. | |
| 9,593,554 | B2 * | 3/2017 | Salihbegovic | E21B 34/14 |
| 9,605,521 | B2 * | 3/2017 | Salihbegovic | E21B 43/123 |
| 9,650,868 | B2 | 5/2017 | Themig et al. | |
| 9,879,509 | B2 * | 1/2018 | De Almeida | E21B 43/123 |
| 9,909,384 | B2 | 3/2018 | Chauffe et al. | |
| 10,161,232 | B2 * | 12/2018 | Salihbegovic | F16K 39/02 |
| 10,273,781 | B2 | 4/2019 | Themig et al. | |
| 10,655,439 | B2 | 5/2020 | Murdoch et al. | |
| 10,787,889 | B2 * | 9/2020 | Salihbegovic | E21B 34/08 |
| 11,643,910 | B2 * | 5/2023 | Salihbegovic | E21B 43/123 166/316 |
| 12,435,606 | B2 * | 10/2025 | Shaw | E21B 43/123 |
| 12,584,389 | B2 * | 3/2026 | Balasubramanian | E21B 43/123 |
| 2002/0046843 | A1 | 4/2002 | Rayssiguier et al. | |
| 2016/0298420 | A1 * | 10/2016 | Shkurti | E21B 34/063 |
| 2021/0010347 | A1 | 1/2021 | Brown | |
| 2021/0340863 | A1 | 11/2021 | Brown | |

* cited by examiner

GAS LIFT VALVE HAVING RATCHETING ORIFICE

CROSS-REFERENCE TO RELATED APPLICATIONS

This application claims the benefit of U.S. Provisional Appl. No. 63/772,523 filed Mar. 15, 2025 and is filed concurrently with U.S. Non-Provisional Appl. Ser. No. 19/089,326, entitled "Gas Lift Valve Having Variable Orifice", both of which are incorporated herein by reference in their entirety.

BACKGROUND OF THE DISCLOSURE

To obtain hydrocarbon fluids from an earth formation, a wellbore is drilled into an area of interest within a formation. The wellbore may then be "completed" by inserting casing in the wellbore and setting the casing using cement. Alternatively, the wellbore may remain uncased as an "open hole"), or it may be only partially cased. Regardless of the form of the wellbore, production tubing is run into the wellbore to convey production fluid (e.g., hydrocarbon fluid, which may also include water) to the surface.

Often, pressure within the wellbore is insufficient to cause the production fluid to naturally rise through the production tubing to the surface. In these cases, an artificial lift system can be used to carry the production fluid to the surface. One type of artificial lift system is a gas lift system, of which there are two primary types of systems: tubing-retrievable gas lift systems and wireline-retrievable gas lift systems. Each type of gas lift system uses several gas lift valves spaced along the production tubing. The gas lift valves allow gas to flow from the annulus into the production tubing so the gas can lift production fluid in the production tubing. Yet, the gas lift valves prevent fluid to flow in the opposite direction from the production tubing into the annulus.

A typical wireline-retrievable gas lift system 10 is shown in FIG. 1. Operators inject compressed gas G into the annulus 22 between the tubing 20 and the casing 24 within a cased wellbore 26. A valve system 12 supplies the injection gas G from the surface and allows produced fluid to exit the gas lift system 10.

Side pocket mandrels 30 spaced along the production string's tubing 20 hold gas lift valves 40 within side pockets 32. As noted previously, the gas lift valves 40 are one-way valves that allow gas flow from the annulus 22 into the tubing 20 and prevent reverse flow from the production string's tubing 20 into the annulus 22.

A production packer 14 located on the tubing 20 of the production string forces the flow of production fluid P from a formation up through the production string's tubing 20 instead of up through the annulus 22. Additionally, the production packer 14 forces the gas flow from the annulus 22 into the production string's tubing 20 through the gas lift valves 40.

In operation, the production fluid P flows from the formation into the wellbore 26 through casing perforations 28 and then flows into the tubing 20. When it is desired to lift the production fluid P, compressed gas G is introduced into the annulus 22, and the gas G enters from the annulus 22 through ports 34 in the mandrel's side pockets 32. Disposed inside the side pockets 32, the gas lift valves 40 control the flow of injected gas I into the production string's tubing 20. As the injected gas I rises to the surface, it helps to lift the production fluid P up the production string's tubing 20 to the surface.

Gas lift valves 40 have been used for many years to assist production of fluid to the surface. The gas lift valve 40 uses pressure-sensitive valve mechanism having a metal bellows and a piston to convert pressure into movement. Injected gas acts on the bellows to open the pressure-sensitive valve mechanism, and the gas passes through the gas lift valve 40 into the tubing string. As differential pressure is reduced on the bellows, the valve mechanism in the gas lift valve 40 can close.

Depending on the completion, other types of downhole devices may be installed in the side pocket mandrels 30. For example, "dummy" valves can be installed in the side pockets 32 of the mandrels 30 to allow for certain pressure tests to be performed. These dummy valves are not actually valves because they merely position in the mandrels 30 to seal of the mandrel's ports 34, acting as isolation devices.

With the dummy valves installed, for example, the integrity of the tubing and the casing of the completion can be tested at high pressures. After testing, the dummy valves are removed and replaced by live gas lift valves 40. Typically, wireline intervention is used to remove the dummy valves from the mandrels 30 and to then install the live gas lift valves 40 in the mandrels 30. The wireline intervention can be very time consuming, technically challenging, and expensive particularly in offshore applications.

The subject matter of the present disclosure is directed to overcoming, or at least reducing the effects of, one or more of the problems set forth above.

SUMMARY OF THE DISCLOSURE

In one configuration, a gas lift valve comprises a housing, a piston, and an indexing assembly. The housing defines an internal passage having a first port, a second port, and a third port. The first port is exposed to an annulus pressure, and the second port is exposed to a tubing pressure. The third port is configured to at least communicate outside the housing. A portion of the internal passage defines a catch profile disposed thereabout. The piston is disposed in the internal passage, and the piston is movable in first and second axial directions with axial movement between first and second positions in the internal passage at least in response to a pressure differential between the first and second ports. The piston in the first and second positions is configured to at least control fluid communication between the first port and the third port.

The indexing assembly has first and second cams. The first cam is disposed on the piston, and the second cam is disposed relative to the first cam. The first cam and the piston in the second position are rotatably indexed in incremental rotations relative to the second cam in response to the axial movement alternatingly in the first and second axial directions. The second cam is configured to alternatingly engage and disengage with the catch profile in response to the incremental rotations of the first cam. The second cam engaged with the catch profile is configured to prevent the axial movement of the piston in the first axial direction, while the second cam disengaged with the catch profile is configured to permit the axial movement of the piston in the first axial direction.

In another configuration, a gas lift valve comprises a housing, a piston, and an indexing assembly. The housing defines an internal passage having a first port, a second port, and a third port. The first port is exposed to an annulus pressure, and the second port is exposed to a tubing pressure. The third port is configured to at least communicate outside the housing. A portion of the internal passage defines a ratchet profile disposed thereabout. The piston is sealed in the internal passage. The piston is movable in first and second axial directions with axial movement between first and second positions in the internal passage at least in response to a pressure differential between the first and second ports. The piston in the first position permits communication between the first port and the third port, whereas the piston in the second position restricts communication between the first port and the third port.

The indexing assembly disposed on the piston and comprises a first ring, a second ring, an inner collar, and an outer collar. The first ring is disposed on the piston and has a first cam surface. The second ring is disposed on the piston and has a second cam surface. The first and second cam surfaces have an offset from one another. The inner collar is attached to the piston. The inner collar has an intermediate outer surface and has first and second intermediate cam surfaces. The first and second intermediate cam surfaces are spaced between the first and second rings, and the intermediate outer surface has outer longitudinal ridges disposed thereabout. The outer collar is disposed about the inner collar and is expandable and contractable. The outer collar has an inner surface and an outer surface. The inner surface has internal longitudinal ridges disposed thereabout, and the outer surface has an outer circumferential ratchet disposed thereabout.

The first and second intermediate cam surfaces are configured to alternately engage the first and second cam surfaces. The offset of the first and second cam surfaces is configured to rotate the piston and the inner collar in incremental rotations in response to the first and second intermediate cam surfaces alternatingly engaged with the first and second cam surfaces. The incremental rotations of the inner collar are configured to alternatingly expand and contract the outer collar in an expanded state and a contracted state in response to the outer longitudinal ridges of the inner collar engaged and disengaged with the inner longitudinal ridges of the outer collar. The outer circumferential ratchet on the outer collar in the expanded state on the piston in the second position is configured to engage with the ratchet profile and is configured to prevent the axial movement of the piston in the first axial direction. The outer circumferential ratchet on the outer collar in the contracted state on the piston in the second position is configured to disengage with the ratchet profile and is configured to allow the axial movement of the piston in the first axial direction.

In yet another configuration, a method is used for a gas lift completion in a wellbore. The method comprises: at least controlling fluid communication through a gas lift valve by: producing pressure differentials in an internal passage of the gas lift valve between an annulus pressure of the wellbore and a tubing pressure of the gas lift completion; and alternatingly moving a pressure-sensitive piston in first and second axial directions with axial movement between first and second positions in the gas lift valve in response to the pressure differentials; holding and releasing the pressure-sensitive piston at least in the second position by: rotatably indexing an indexing assembly in incremental rotations in response to the axial movement of the pressure-sensitive piston in the second position alternatingly in the first and second axial directions; alternatingly expanding and contracting an outer circumferential ratchet in expanded and contracted states in response to the incremental rotations of the indexing assembly on the pressure-sensitive piston in the second position; and alternatingly preventing and allowing the axial movement of the pressure-sensitive piston in the first axial direction from the second position by alternatingly engaging and disengaging the outer circumferential ratchet in response to the expanded and contracted states with a ratchet profile defined in the internal passage.

The foregoing summary is not intended to summarize each potential embodiment or every aspect of the present disclosure.

DETAILED DESCRIPTION OF THE DISCLOSURE

Figure 1:
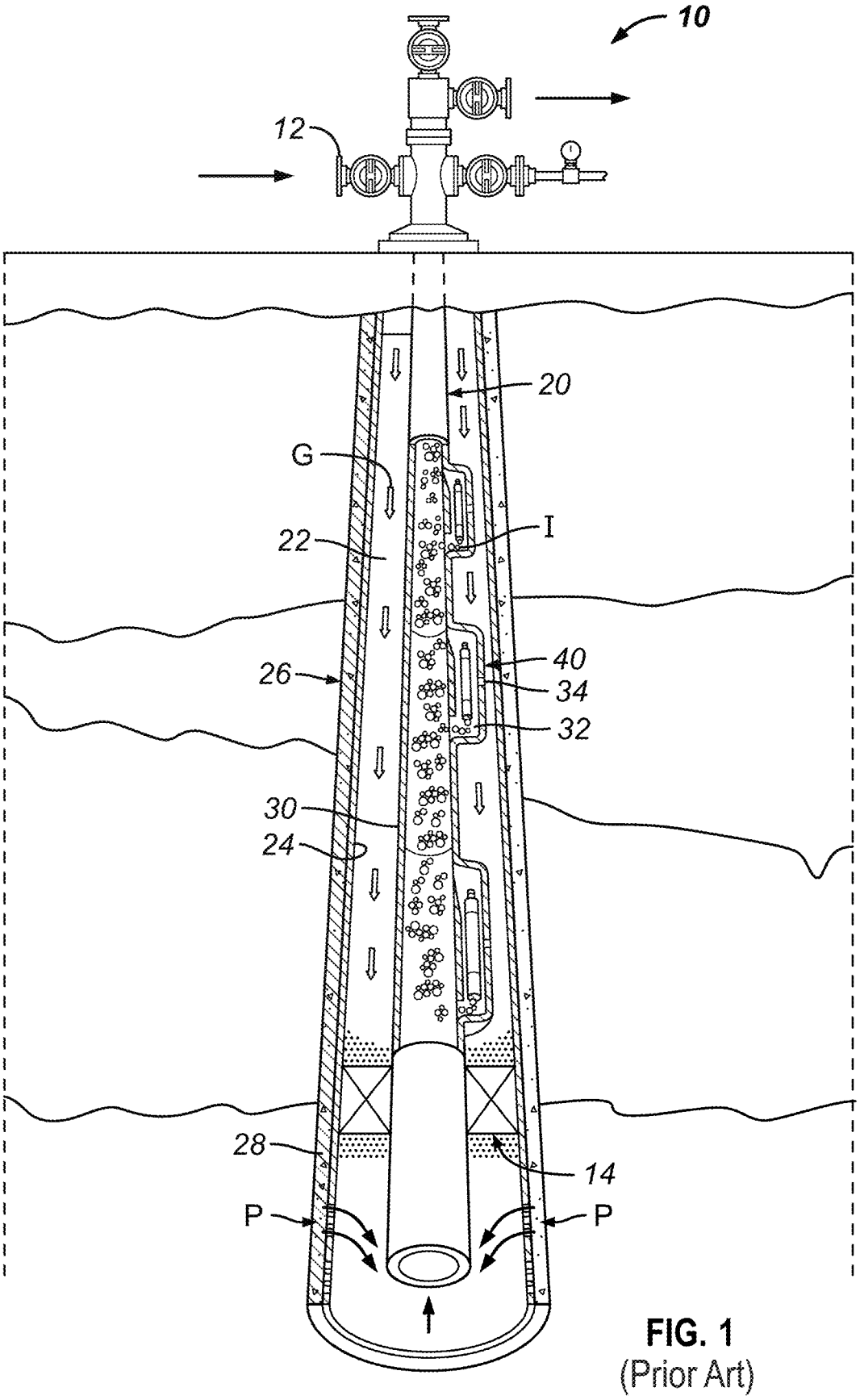
FIG. 1 (Prior Art)
FIG. 1 illustrates a conventional gas lift system.
Figure 2A:
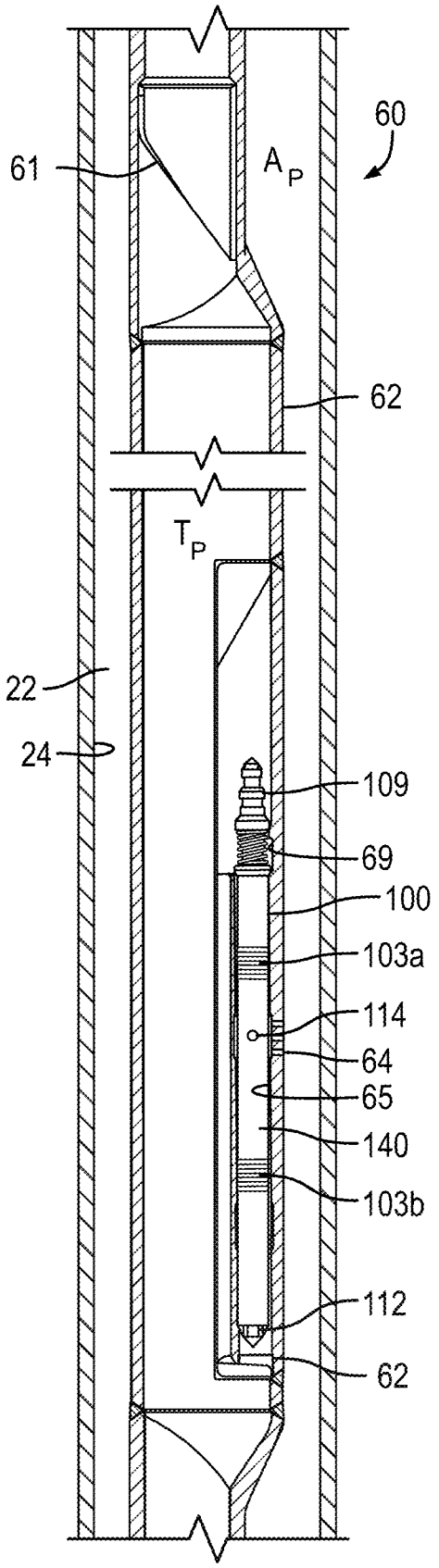
FIG. 2A illustrates a gas lift mandrel with a gas lift valve of the present disclosure installed.

Referring to FIG. 2A, a gas lift mandrel 60 is installed on tubing 20 of a production or completion string for a wellbore completion assembly. The mandrel 60 is shown with a gas lift valve 100 of the present disclosure installed. As shown here, the gas lift valve 100 is wireline-retrievable, but the teachings of the present disclosure can apply to other types of valves, such as tubing-retrievable valves when used with an appropriate mandrel and tubing running procedures. The gas lift valve 100 includes an indexing assembly 140 according to the present disclosure. The indexing assembly 140 can initially keep the gas lift valve 100 in a closed condition, but the indexing assembly 140 can be selectively activated to open the gas lift valve, as discussed later.

While the gas lift valve 100 is in the closed condition, the gas lift valve 100 can be run into the tubing 20 by wireline and can be inserted into the side pocket 65 of the mandrel 60. A latch 109 of the gas lift valve 100 engages a profile 69 in the side pocket 65 to hold the gas lift valve 100 therein. Packing seals 103*a-b* on the gas lift valve 100 isolate fluid communication between a port 64 on the mandrel 60 and a side port 114 on the gas lift valve 100.

The gas lift valve 100 with the indexing assembly 140 can be an unloading-type of gas lift valve used for a typical tubing flow application. In this instance as will be described throughout the present disclosure, gas is injected down the annulus 22 in order to enter the tubing 20 through the mandrel 60 and the gas lift valve 100 so the injected gas can then lift production fluid up the tubing 20. In general, the side port 114 of the gas lift valve 100 is an inlet exposed to the annulus 22, while the end port 112 of the gas lift valve 100 is an outlet exposed to the tubing 20. The indexing assembly 140 operates with the pressure differential between the ports 112, 114 to configure the opening and closing of the gas lift valve 100.

As an alternative, the gas lift valve 100 with the indexing assembly 140 can be used in an annular flow configuration in which gas is instead injected down the tubing 20 in order to enter the annulus 22 through the gas lift valve 100 and the mandrel 60 so the injected gas can then lift production fluid up the annulus 22. Although the annular flow configuration is less common, it is applied in certain circumstances. To achieve the annular flow configuration, features and operation of the disclosed gas lift valve 100 and the indexing assembly 140 are essentially reversed, and a different form of gas lift mandrel may be used. In this case, the end port 112 of the gas lift valve 100 is an inlet exposed to the tubing 20, while the side port 114 of the gas lift valve 100 is an outlet exposed to the annulus 22. The indexing assembly 140 operates with the pressure differential between the ports 112, 114 to configure the opening and closing of the gas lift valve 100.

Instead of being conventional, the gas lift valve 100 is configured to be selectively opened and closed during operations. For example, the indexing assembly 140 can keep the gas lift valve 100 closed so pressure testing can be performed. For pressuring testing, the tubing pressure $T_P$ can be increased in the tubing 20 to test the tubing's integrity. Alternatively, the annulus pressure $T_P$ can be increased to test the casing's integrity.

The gas lift valve 100 can also be selectively opened when ready to inject gas through the side pocket mandrel 60 and the gas lift valve 100 for entry into the tubing 20 of the completion string. In particular, the gas lift valve 100 is configured to open and close at different predetermined pressure differentials between the annulus pressure $A_P$ and the tubing pressure $T_P$ so the gas lift valve 100 can be used for gas injection. In this way, wireline intervention to remove a dummy valve and replace it with a live gas lift valve is not needed to test the completion's integrity or to selectively change the gas injection point as required in conventional practice.

Figure 2B:
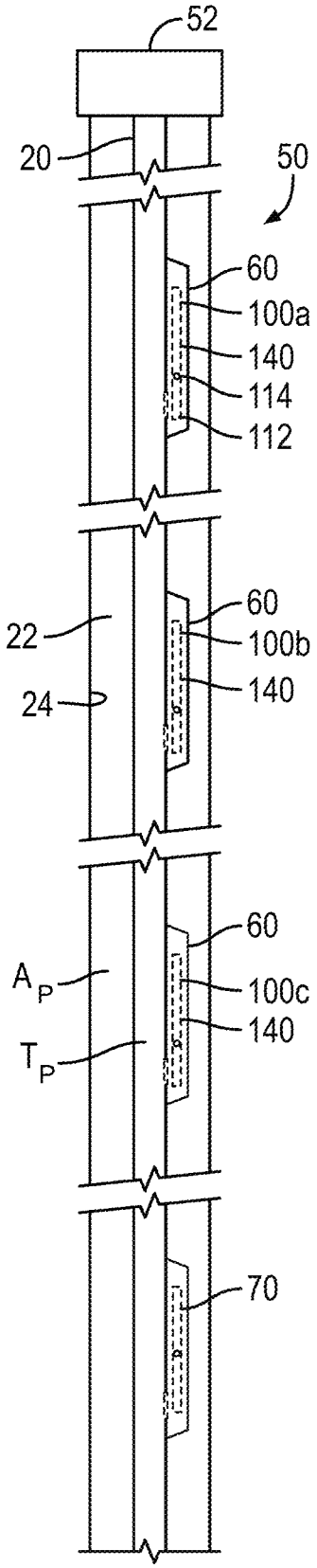
FIG. 2B illustrates a completion having gas lift valves according to the present disclosure.

An example completion assembly 50 is shown in FIG. 2B having multiple gas lift valves 100*a-c* installed on tubing 20 of a production or completion string disposed in casing 24 of a wellbore. Each of the gas lift valves 100*a-c* is installed in a gas lift mandrel 60 on the production string's tubing 20, and each of the valves 100*a-c* can have an indexing assembly 140 to control the selective opening and closing of the gas lift valve 100.

The multiple gas lift valves 100*a-c* can be used together with a shearable orifice valve 70 installed at the deepest point in the completion assembly 50. The shearable orifice valve 70 has a shear open mechanism set to open at a higher pressure than the activation pressure for the indexing assembly 140 on the gas lift valves 100. An example of such a shearable orifice valve 70 is the "RDDK-2A Shearable Orifice Gas-Lift Valve" available from Weatherford International, Inc.

The indexing assemblies 140 allow the casing 24, the tubing 20, and other components (e.g., packers) in the well completion assembly 50 to be tested. Then, the gas lift valves 100 can be selectively activated open and closed to configure the locations for gas injection on the tubing 20.

In one configuration, the indexing assemblies 140 are configured to open the gas lift valves 100 in response to a predetermined pressure differential between the annulus pressure $A_P$ and the tubing pressure $T_P$ (e.g., the annulus pressure $A_P$ in the annulus 22 increased a predetermined level above the tubing pressure $T_P$). As used herein, "annulus pressure" $A_P$ refers to the pressure in the annulus 22 between the tubing 20 and the wellbore casing 24. By contrast, "tubing pressure" $T_P$ refers to the pressure in the tubing 20 of the production string in the wellbore.

One or more of the indexing assemblies 140 can be configured for one predetermined pressure differential offset from or different from one or more others of the indexing assemblies 140. Therefore, one or more of the gas lift valves 100*a-c* can be closed, while others of the gas lift valves remain closed or are closed. Any desirable arrangement can be used so operators can select the locations where gas injection is to occur in the completion assembly 50.

For example, the tubing 20 and the annulus 22 are filled with completion fluid, which creates hydro-static pressure on the ports 112, 114 of the gas lift valves 100. Operators first perform a tubing test by increasing the tubing pressure $T_P$ to a set test pressure. This tests the integrity of the tubing 20 of the production string. The operators then bleed off the tubing pressure $T_P$.

At this point, operators increase the annulus pressure $A_P$ to apply a set test pressure to the annulus 22 from the surface. This increase in annulus pressure $A_P$ tests packers (not shown) and the casing 24 of the completion assembly 50 by creating a pressure differential between the casing 24 and the tubing 20.

With the casing's integrity tested, the annulus pressure $A_P$ is then increased to a first predetermined level above the set test pressure to open one or more of the gas lift valves 100. The annulus pressure $A_P$ is then increased even further to a second, higher predetermined level to open the shearable orifice valve 70.

Once the annulus pressure $A_P$ reaches the opening pressure differential of the shearable orifice valve 70, the annulus and tubing pressures $A_P$, $T_P$ throughout the wellbore will equalize. With the pressures $A_P$, $T_P$ then equalized, the gas lift valves 100 in open conditions are ready for gas injection operations. At any desired point during gas injection, the operators can then cycle the pressures $A_P$, $T_P$ to selectively open/close one or more of the gas lift valves 100 to change the location for the gas injection in the completion assembly 50.

In an alternative, the indexing assemblies 140 of the gas lift valves 100 can be configured to open after testing in response to increased tubing pressure $T_P$. (This installation may not use the shearable orifice valve 70 on the completion assembly 50.) During testing, for example, the tubing 20 and the annulus 22 are filled with completion fluid, which creates hydro-static pressure on each side of the gas lift valves 100. Operators first perform a casing integrity test by increasing the annulus pressure $A_P$ from the surface to a set test pressure. This increase in annulus pressure $A_P$ tests any packers and tests the casing 24 of the completion assembly 50 by creating a pressure differential in the annulus 22 relative to the tubing 20. The annulus pressure $A_P$ is then bled off.

Operators then increase the tubing pressure $T_P$ to a predetermined level that opens one or more of the gas lift valves 100. Although the gas lift valves 100*a-c* are now open, certain check valves in the gas lift valves 100*a-c* may close and prevent reverse flow of pressure from the tubing 20 to the annulus 22. The operators now test the tubing integrity by increasing the tubing pressure $T_P$ to a set test level. The tubing pressure $T_P$ is then bled off, and the gas lift valves in open conditions are ready for gas injection. Again, at any desired point during gas injection, the operators can then cycle the pressures $A_P$, $T_P$ to selectively open/close one or more of the gas lift valves 100*a-c* to change the location for the gas injection in the completion assembly 50.

Having an understanding of how an indexing assembly 140 of the present disclosure is used on a gas lift valve 100 in a completion assembly 50, discussion now turns to particular details of the indexing assembly 140.

Figure 3A:
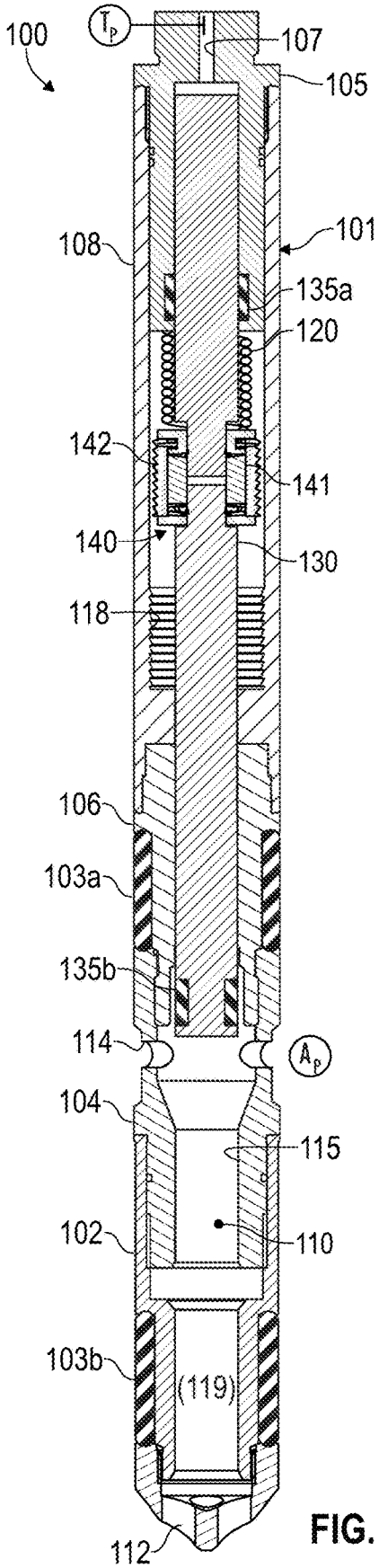
FIG. 3A illustrates a cross-sectional view of a gas lift valve having an indexing assembly according to the present disclosure.

Referring to FIG. 3A, a gas lift valve 100 is shown in cross-section. In this example, the gas lift valve 100 is an unloading-type of gas lift valve, and the indexing assembly 140 is configured to open and close the gas lift valve 100 in response to pressure differentials between the annulus pressure $A_P$ and the tubing pressure $T_P$.

As noted above, the gas lift valve 100 and indexing assembly 140 allow operators to select an injection point for gas lift without the need of a workover in the completion. By cycling the pressure differential between tubing pressure $T_P$ and annulus pressure $A_P$, the indexing assembly 140 cycles the gas lift valve 100 between an open state and a closed state.

The gas lift valve 100 has a housing 101, a piston 130, and an indexing assembly 140. The housing 101 defines an internal flow passage 110 therein and has an end port 112 and a side port 114. In one configuration, the end port 112 can be an outlet exposed to tubing pressure $T_P$ of the tubing, while the side port 114 can be an inlet exposed to the annulus pressure $A_P$. A check valve (119) can be disposed in the internal passage (110). The check valve (119) can permit fluid communication from the internal passage (110) to the end port (112) and can prevent fluid communication from the end port (112) to the internal passage (110). A reverse arrangement of exposure can be used.

For ease of assembly, the housing 101 can be composed of several housing components connected together. For example, the housing components can include an end port housing 102, a side port housing 104, a piston adapter 106, a piston housing 108, and a tail piece 105. The end port housing 102 has the end port 112 communicating with internal flow passage 110, and the side port housing 104 has the side port 114 communicating with the internal flow passage 110. The tail piece 105 defines a tail port 107, which also communicates with the internal flow passage 110. A latch (not shown) can be affixed to the tail piece 105, but the tail port 107 can still be allowed to communicate fluid pressure.

The annular seal 103*a-b*, such as packing stacks, are disposed about the housing 101 on both sides of the side port 114. In this way, the annular seals 103*a-b* seals the side port 114 from the end port 112 and tail port 107 and isolates the annulus pressure $A_P$ and the tubing pressure $T_P$ when installed in a typical side-pocket gas lift mandrel (e.g., 60; FIG. 2A). Accordingly, the gas lift valve 100 of FIG. 3A run into the mandrel (60) is exposed to annular pressure $A_P$ through the side port 114 communicating with the mandrel's injection ports (64), and the end port 112 and the tail port 107 are exposed to tubing pressure $T_P$. Thus, the term "annular pressure" used in reference to the gas lift valve 100 refers to the pressure in the wellbore annulus at the side port 114 of the gas lift valve 100, whereas the term "tubing pressure" refers to the pressure in the completion string at the end port 112 and the tail port 107 of the gas lift valve 100.

The piston 130 is disposed in the internal flow passage 110 of the housing 101, and the indexing assembly 140 is disposed on the piston 130. An upper annular seal 135*a*, on the tail piece 105 seals against an upper end of the piston 130, while a distal end of the piston 130 has a lower annular seal 135*b*, which can seal inside a throat 115 of the internal flow passage 110. The seals 135*a-b* for the piston 130 can use seal stacks for increased reliability. There may be a difference in the seal bore diameters to provide a measure of bias to the piston 130. A biasing element 120, such as a spring, is engaged in the piston housing 108 between a shoulder of the tail piece 105 and the indexing assembly 140.

For assembly purposes, the piston 130 can be made up of two or more sections. For example, an upper section and a lower second can thread at the indexing assembly 140.

In general, the side port 114 is exposed to annulus pressure of the wellbore, and the tail port 107 is exposed to the tubing pressure. The end port 112 is configured to at least communicate outside the housing 101. The piston 130 is disposed in the internal flow passage 110. Being pressure-sensitive, the piston 130 is movable with axial movement in first and second axial directions between first and second positions in the internal flow passage 110 at least in response to a pressure differential between the side port 114 and the tail port 107. The piston 130 in the first and second positions is configured to at least control fluid communication between the side port 114 and the end port 112. For instance, the piston 130 in the first (upward) position opens the gas lift valve 100, permitting fluid communication between the side port 114 and the end port 112. However, the piston 130 in the second (downward) position closes the gas lift valve 100, preventing fluid communication between the side port 114 and the end port 112. Instead of open and closed conditions, the gas lift valve can have an opened flow condition and at least a restricted flow condition (in which the piston 130 does not fully seal inside the throat 115).

Fluid communication through the gas lift valve 100 can at least be controlled by: producing pressure differentials in the internal flow passage 110 of the gas lift valve 100 between annulus pressure of the wellbore and tubing pressure of the gas lift completion; and alternatingly moving the pressure-sensitive piston 130 with axial movement in first and second axial directions between first and second positions in the gas lift valve 100 in response to the pressure differentials.

The pressure-sensitive piston 130 can be held in (and released from) at least in the second position by: rotatably indexing the indexing assembly 140 in incremental rotations in response to the axial movement of the piston 130 in the second position alternatingly in the first and second axial directions; alternatingly expanding and contracting an outer circumferential catch (or ratchet) 168 in expanded and contracted states in response to the incremental rotations of the indexing assembly 140 on the piston 130 in the second position; and alternatingly preventing and allowing the axial movement of the piston 130 in the first axial direction from the second position by alternatingly engaging and disengaging the outer circumferential ratchet 168 in response to the expanded and contracted states with a catch (or ratchet) profile 118 defined in the internal flow passage 110.

The ratchet profile 118 can include one or more shoulders, rims, ledges, or the like. Likewise, the ratchet 168 can include one or more shoulders, rims, ledges, or the like complimentary to the ratchet profile 118. As shown, the ratchet profile 118 can use a profile of ratchets (e.g., a ratchet profile), and the catch 168 can use a complementary profile of ratchets (e.g., a ratchet). Engagement between the ratchet 168 with the ratchet profile 118 can prevent movement of the ratchet 168 in the first axial (upward) direction relative to the rachet profile 118, but may allow movement in the second axial (downward) direction. These and other forms of engagement can be used.

In general, the indexing assembly 140 has a first (inner) cam 141 and a second (outer) cam 142. The inner cam 141 is disposed on the piston 130, and the outer cam 142 is disposed relative to the inner cam 141. The inner cam 141 and the piston 130 in the second (downward) position are rotatably indexed in incremental rotations relative to the outer cam 142 in response to the axial movement of the piston 130 alternatingly in the first and second axial directions. The outer cam 142 is alternately expanded and contracted in expanded and contracted states in response to the incremental rotations of the inner cam 141. The outer cam 142 in the expanded state on the piston 130 in the downward position is configured to engage with the ratchet profile 118 and is configured to prevent the axial movement of the piston 130 in the upward axial direction. Meanwhile, the outer cam 142 in the contracted state on the piston 130 in the downward position is configured to be disengaged with the ratchet profile 118 and is configured to permit the axial movement of the piston 130 in the upward axial direction.

Figure 3B:
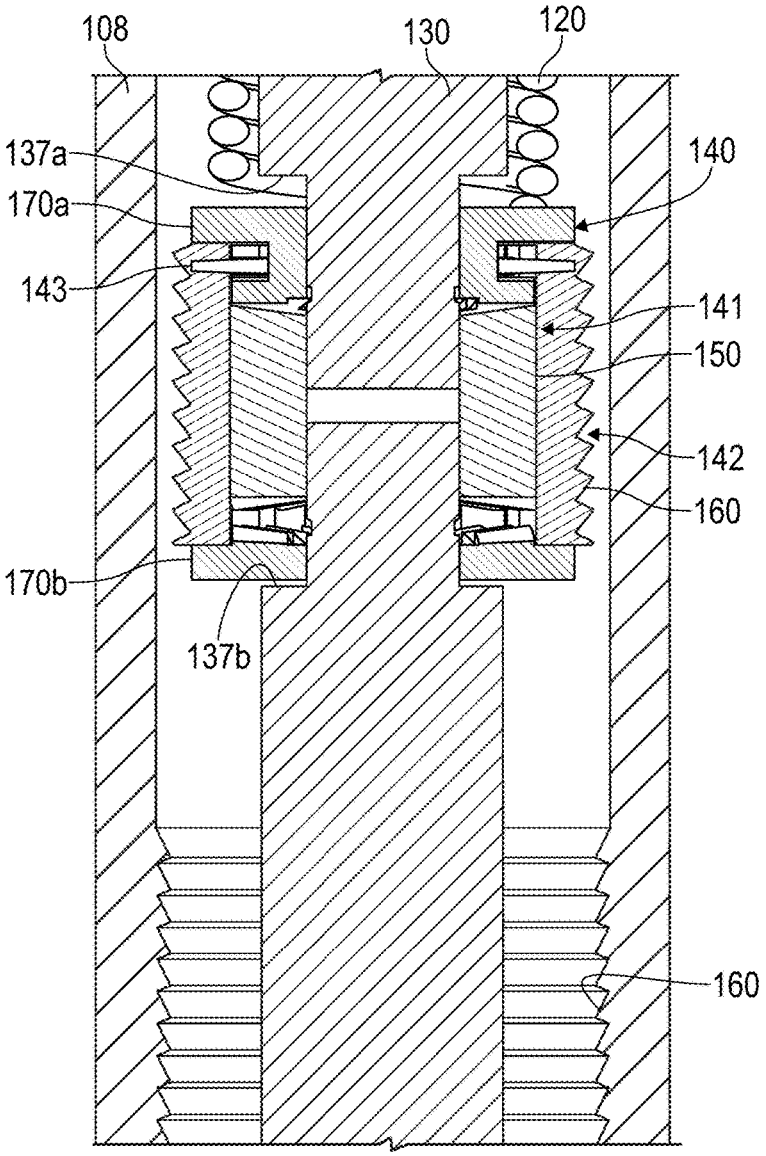
FIG. 3B illustrates the indexing assembly of FIG. 3A in more detail.

Further details of the indexing assembly 140 are shown in FIG. 3B. For example, the piston 130 is movable with axial movement in first and second (upward and downward) axial directions in the internal flow passage 110. In particular, the piston 130 acting against the bias of the spring 120 can be movable in the upward direction in response to tubing pressure $T_P$ communicated via the tail port 107 being less than annular pressure $A_P$ in the internal flow passage 110. By contrast, the piston 130 biased by the spring 120 can be movable in the downward direction in response to tubing pressure $T_P$ communicated via the tail port 107 being greater than annular pressure $A_P$ in the internal flow passage 110. When the piston 130 is moved in the downward direction, the indexing assembly 140 is moved toward a portion of the internal flow passage 110 defining a ratchet profile 118 having inner circumferential ratchets.

For the inner and outer cams 141, 142, the indexing assembly 140 includes an inner collar 150, an outer collar 160, and upper and lower catch rings 170*a-b*. (Further details of each of the inner collar 150, the outer collar 160, and the catch rings 170*a-b* are provided in the isolated view of FIGS. 15A through 18C.) As will be evident below, the upper catch ring 170*a*, the lower catch ring 170*b*, and the outer collar 160 are kept axially aligned with each other and are isolated from the rotation from the piston 130.

Figure 17A:
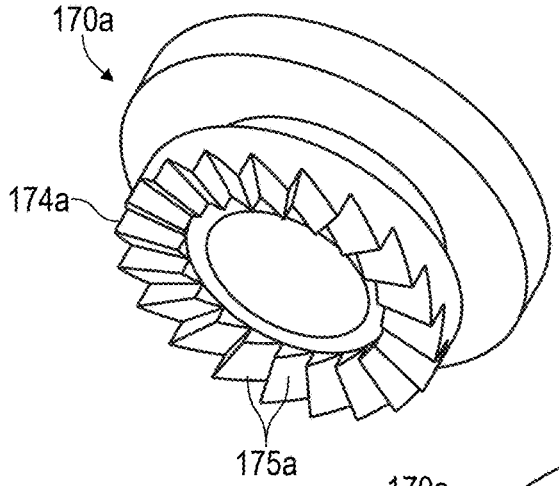
FIGS. 17A-17C illustrate perspective, elevational, and bottom plan views of an upper catch ring of the disclosed indexing assembly.
Figure 17B:
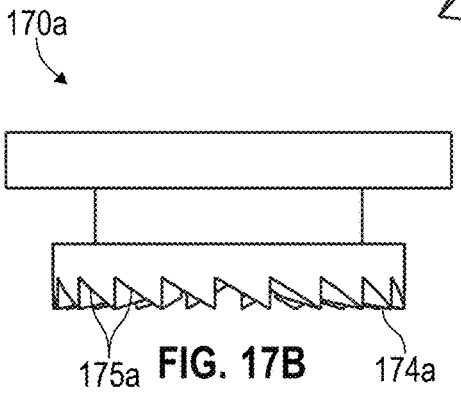
Figure 17C:
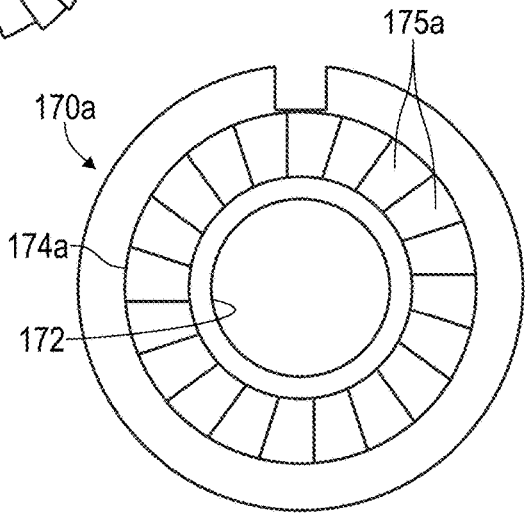
Figure 18A:
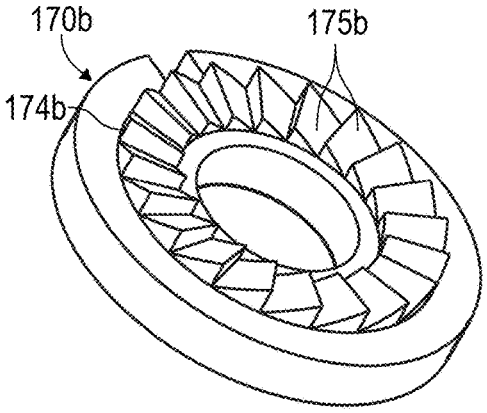
FIGS. 18A-18C illustrate perspective, elevational, and top plan views of a lower catch ring of the disclosed indexing assembly.
Figure 18B:
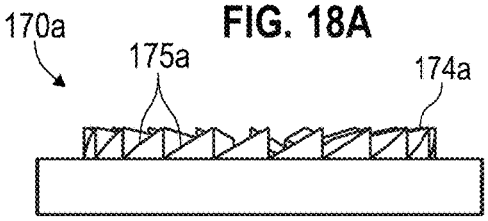
Figure 18C:
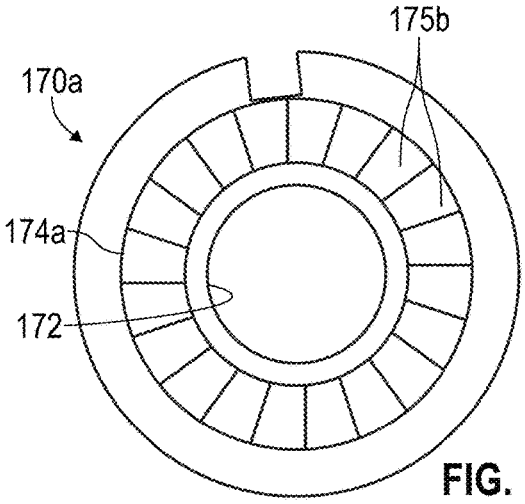

The first (upper) catch ring 170*a* is disposed on the piston 130 and has a first cam 175*a*. (FIGS. 17A-17C illustrate perspective, elevational, and bottom plan views of an upper catch ring 170*a*.) The upper catch ring 170*a* can have one or more radial pins 143 engaged in a circumferential slot about the upper catch ring 170*a*. These radial pins 143 can be engaged in holes at the upper end of the outer collar 160 so the upper catch ring 170*a* and outer collar can tend to move together with each other. Meanwhile, the second (lower) ring 170*b* disposed on the piston 130 has a second cam 175*b*. The first and second cams 175*a-b* have an offset from one another. (FIGS. 18A-18C illustrate perspective, elevational, and top plan views of the lower catch ring 170*b*.)

Figure 15A:
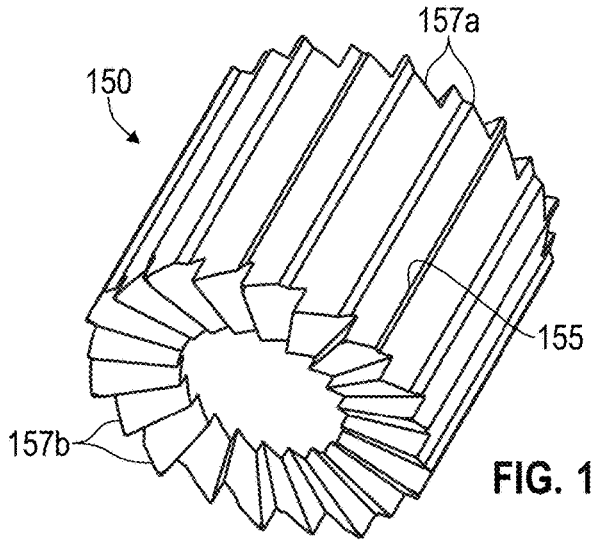
FIGS. 15A-15C illustrate perspective, elevational, and plan views of an inner collar of the disclosed indexing assembly.
Figure 15B:
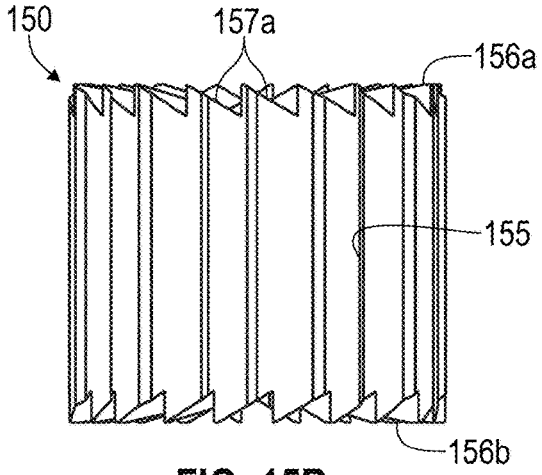
Figure 15C:
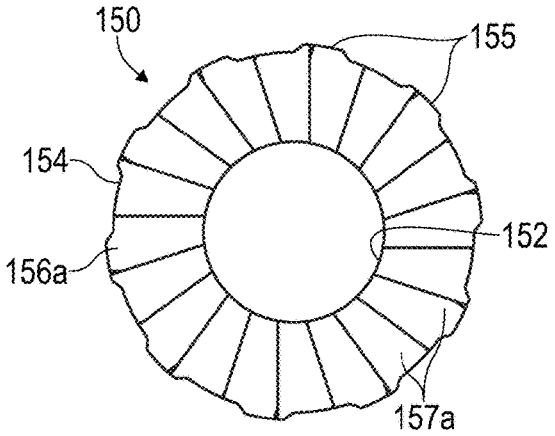

The inner collar 150 is disposed on the piston 130 and has an inner surface 152, an intermediate outer surface 154, and first and second intermediate ends 156*a-b*. (FIGS. 15A-15C illustrate perspective, elevational, and plan views of the inner collar 150.) For assembly purposes, sections of the piston 130 can thread into the inner surface 152 of the inner collar 150. The intermediate ends 156*a-b* are spaced between the first and second catch rings 170*a-b*. The first intermediate end 156*a* has a first intermediate cam 157*a* configured to engage the upper cam 175*a* on the upper catch ring 170*a* when positioned against one another. Meanwhile, the second intermediate end 156*b* has a second intermediate cam 157*b* configured to engage the lower cam 175*b* when positioned against one another. Additionally, the intermediate outer surface 154 has outer longitudinal ridges 155 disposed therebout. These longitudinal ridges 155 extend in a longitudinal direction on the outer surface 154 and are separated from one another by gaps, spaces, or slots about the collar's outer circumference.

Figure 16A:
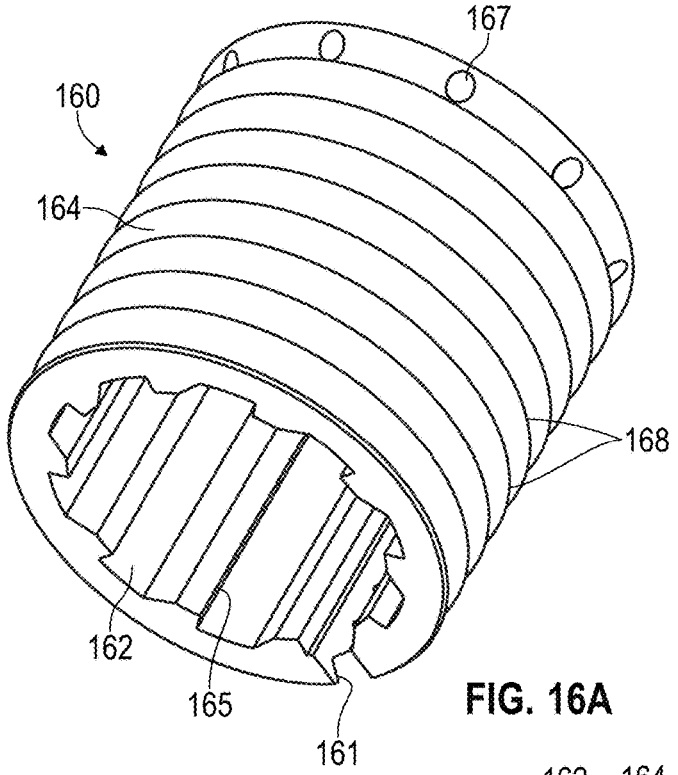
FIGS. 16A-16C illustrate perspective, elevational, and plan views of an outer collar of the disclosed indexing assembly.
Figure 16B:
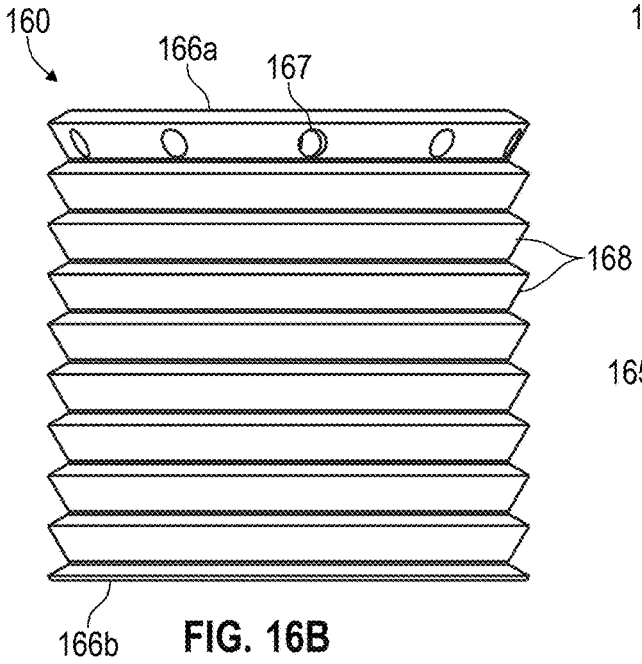
Figure 16C:
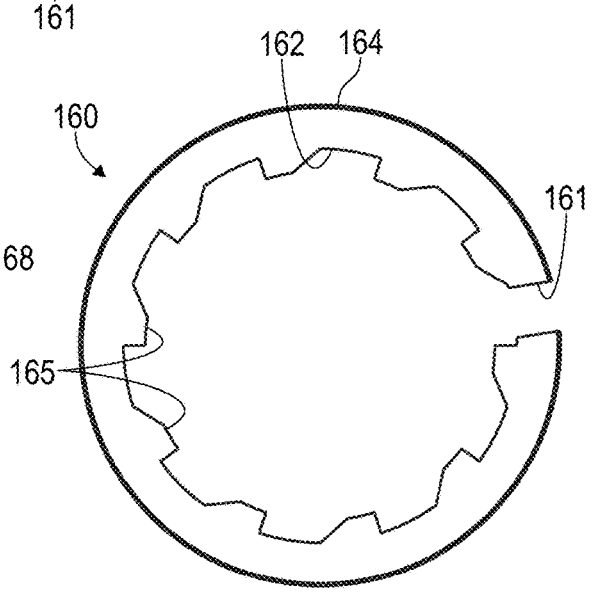

The outer collar 160 is disposed about the inner collar 150 and is expandable and contractable. (FIGS. 16A-16C illustrate perspective, elevational, and plan views of the outer collar 160.) The outer collar 160 can be a split ring, a C-ring, or a segmented ring. For example, the outer collar 160 can be a sleeve defining a longitudinal split 161. The outer collar 160 has an inner surface 162, an outer surface 164, and first and second ends 166*a-b*. The first and second ends 166*a-b* are disposed at the first and second catch rings 170*a-b*. (As shown in FIGS. 16A-16C, the upper end 166*a* of the outer collar 160 can define holes 167 to accommodate stabilizing radial pins (143; FIG. 3B), as discussed below). The inner surface 162 has internal longitudinal ridges 165 disposed thereabout, and the outer surface 164 has outer circumferential ratchet 168 disposed thereabout. The inner longitudinal ridges 165 extend in a longitudinal direction on the inner surface 162 and are separated from one another by gaps, spaces, or slots about the collar's inner circumference.

During operation described in more detail below, the intermediate cams 157*a-b* on the inner collar 150 are configured to alternately engage the cams 175*a-b* on the catch rings 170*a-b*. The offset of the cams 175*a-b* is configured to rotate the piston 130 and the inner collar 150 in incremental rotations in response to the intermediate cams 157*a-b* alternatingly engaged with the cams 175*a-b*. These incremental rotations of the inner collar 150 are configured to alternately expand and contract the outer collar 160 in expanded and contracted states in response to the outer longitudinal ridges 155 of the inner collar 150 engaged and disengaged with the inner longitudinal ridges 165 of the outer collar 160.

The outer circumferential ratchet 168 on the outer collar 160 in the expanded state can engage with the ratchet profile 118 and can prevent the axial movement of the piston 130 in the first (upward) axial direction. Meanwhile, the outer circumferential ratchet 168 on the outer collar 160 in the contracted state can disengage from the ratchet profile 118 to allow the axial movement of the piston in the first (downward) axial direction.

The piston 130 defines first and second shoulders 137*a-b*, and the first and second catch rings 170*a-b* are spaced between the first and second shoulders 137*a-b*. The catch rings 170*a-b* and the outer collar 160 of the indexing assembly 140 are axially movable on the piston 130 relative to the inner collar 150 and can be moved between the first and second shoulders 137*a-b*. Meanwhile, the inner collar 150 is affixed to the piston 130. As noted above, for example, ends of the two sections of the piston 130 can thread into the inner surface 152 of the inner collar 150.

The spring 120 biases between an upper surface or shoulder in the piston housing 108 and the upper catch ring 170*a* on the piston 130. Meanwhile, the internal flow passage 110 defines a lower surface or shoulder opposite to the upper shoulder, and the second catch ring 170*b* is configured to engage this lower shoulder when the piston 130 is moved to a lower position.

The ratchet profile 118 is defined in the piston housing 108 adjacent to the lower shoulder. The outer circumferential ratchet 168 on the outer collar 160 are configured to ratchet past the ratchet profile 118 in response to the axial movement of the piston 130 in the downward axial direction. However, the outer circumferential ratchet 168 on the outer collar 160 when expanded are configured to lock against the ratchet profile 118 in response to the axial movement of the piston 130 in the upward axial direction.

Figure 4A:
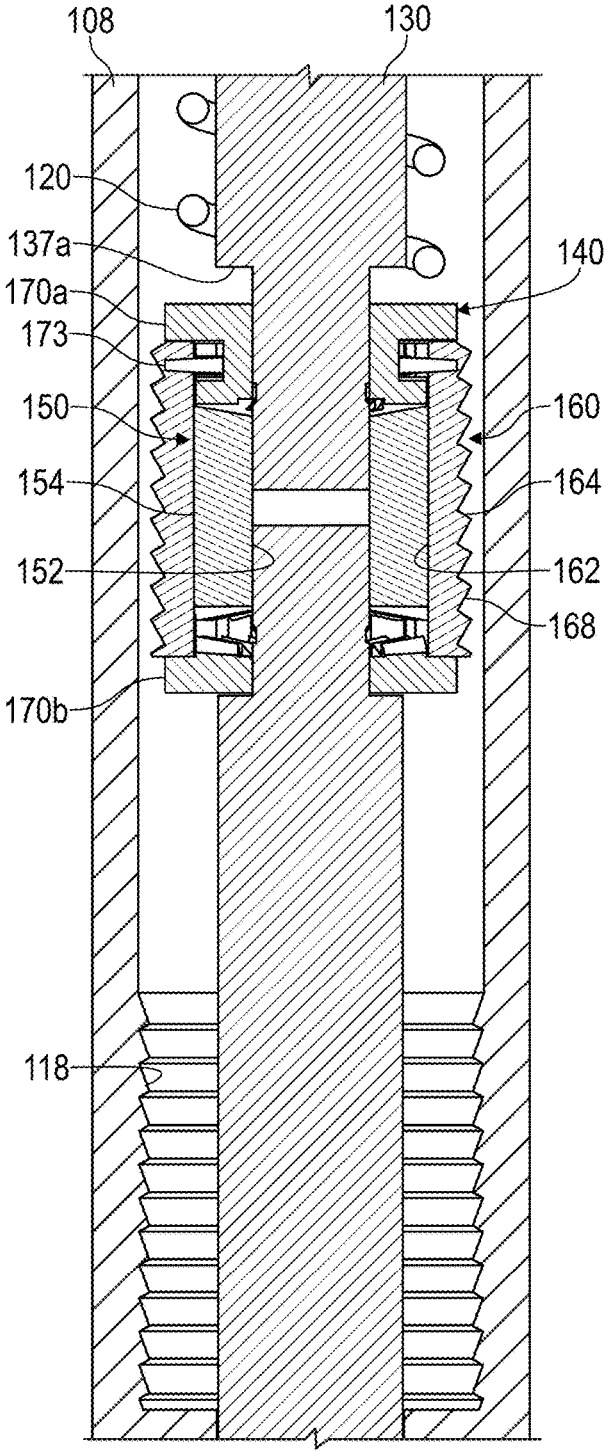
FIG. 4A illustrates an isolated view of a portion of the piston, catch rings, and inner ring of the indexing assembly in a first stage of operation.
Figure 4C:
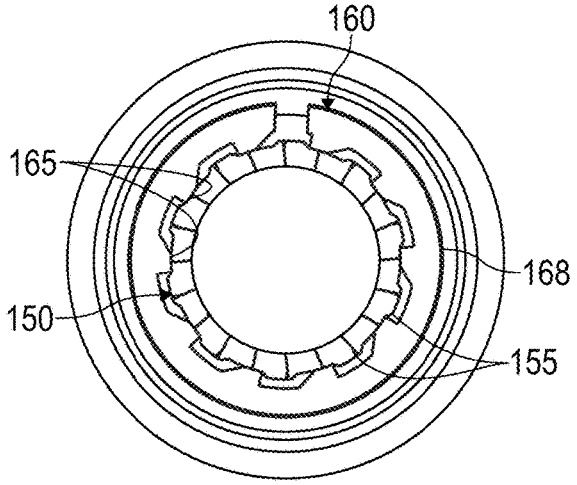
FIG. 4C illustrates a plan view of the indexing assembly in the first stage of operation.
Figure 4B:
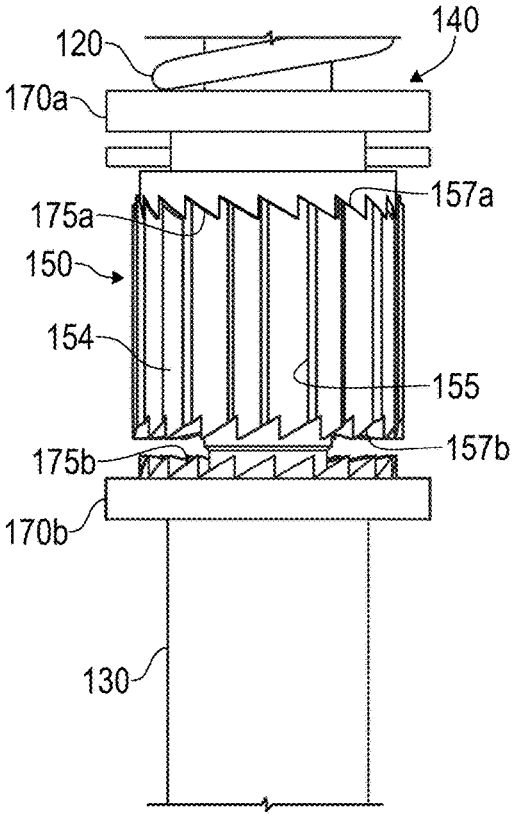
FIG. 4B illustrates a cross-sectional view of a detailed portion of the indexing assembly in the first stage of operation.
Figure 5:
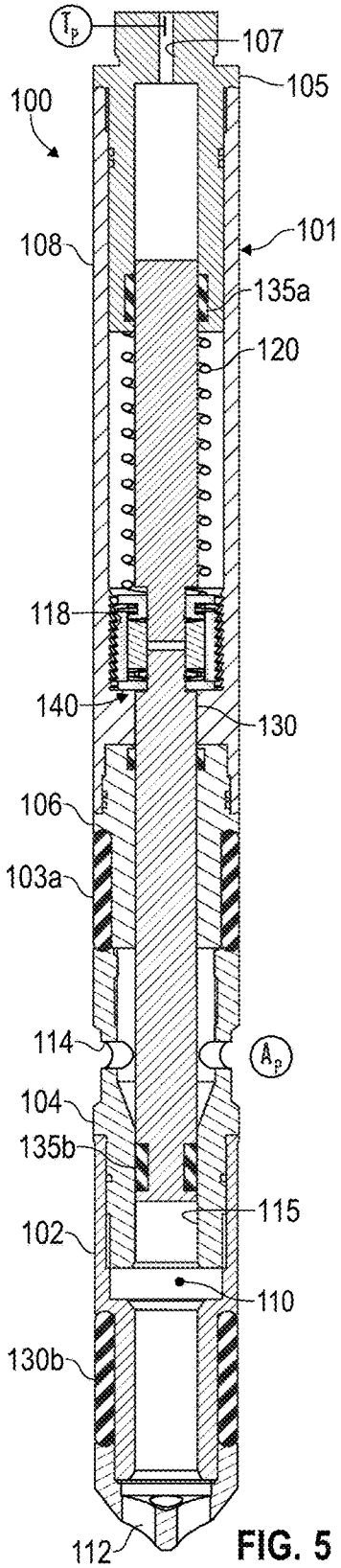
FIGS. 5 and 6A-6C illustrate various views of the indexing assembly in a second stage of operation.
Figure 7:
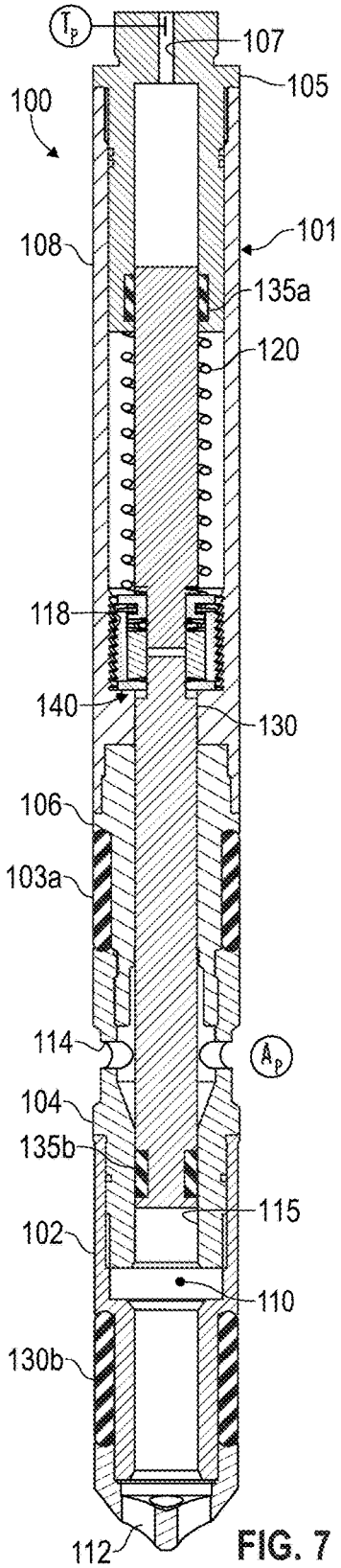
FIGS. 7 and 8A-8C illustrate various views of the indexing assembly in a third stage of operation.
Figure 9:
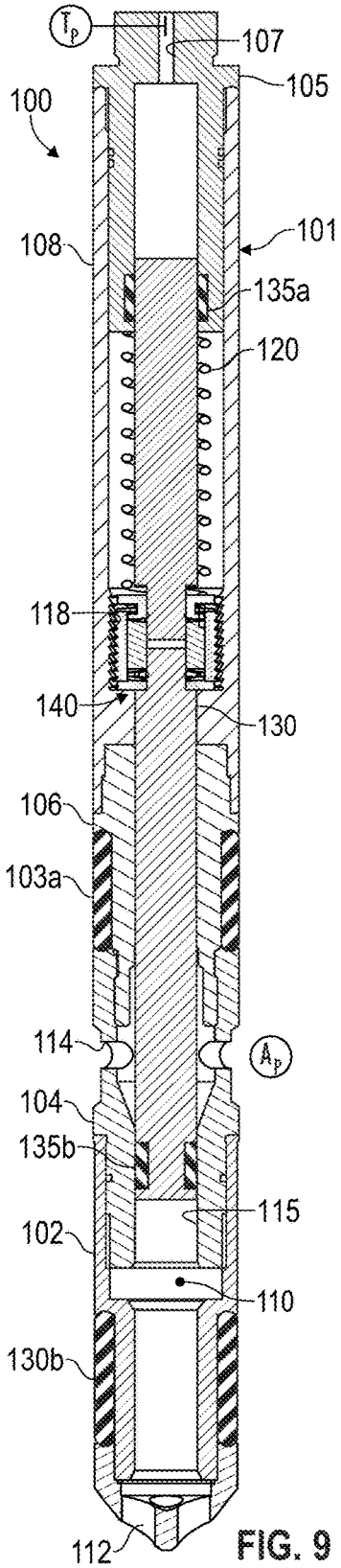
FIGS. 9 and 10A-10C illustrate various views of the indexing assembly in a fourth stage of operation.

Discussion now turns to operation of the gas lift valve 100 and the indexing assembly 140 when selectively switching the gas lift valve 100 between opened and closed conditions. FIG. 4A illustrates a cross-sectional view of a detailed portion of the indexing assembly 140 in a first stage of operation. FIG. 4B illustrates an isolated view of a portion of the piston 130, the inner collar 150, and the catch rings 170*a-b* of the indexing assembly 140 in the first stage of operation, and FIG. 4C illustrates a plan view of the indexing assembly 140 in the first stage of operation. (Certain components, such as the upper catch ring, pins, etc. are not shown in FIG. 4C so that other components are visible.)

As best shown in FIG. 4B, the first cam 175*a* and the first intermediate cam 157*a* define first complementary ramped teeth. Meanwhile, the second cam 175*b* and the second intermediate cam 157*b* define second complementary ramped teeth. The ramps of the first intermediate cam 157*a* are oriented in a first direction, while the ramps of the second intermediate cam 157*b* are oriented in a second, opposite direction.

In this first stage, the gas lift valve 100 is fully open. Therefore, the annulus pressure $A_P$ at the side port 114 is greater than the tubing pressure $T_P$ at least at the tail port 107 by a predetermined amount. The pressure differential produces an upward force on the piston 130 that is greater than the combined force from the tubing pressure $T_P$ at the tail port 107 and the bias of the spring 120. The piston 130 is moved to an upper position. Consequently, the indexing assembly 140 is moved away from the ratchet profile 118, and the lower piston seal 135*b* has moved out of the throat 115 in the internal flow passage 110.

Injected gas can communicate from the side port 114 to the end port 112. The gas lift valve 100 can remain in this fully open condition as long as desired. At some point during operations, operators may want to then close this gas lift valve 100. For example, another gas lift valve 100 may be selectively opened to provide gas injection at another point in the completion assembly.

FIGS. 5 and 6A-6C illustrate the indexing assembly 140 in a second stage of operation. In this second stage, the gas lift valve 100 is in the process of closing. The tubing pressure $T_P$ at the tail port 107 is greater than the annulus pressure $A_P$ by a predetermined amount. (This can be done by either increasing the tubing pressure $T_P$ or decreasing the annulus pressure $A_P$.) The pressure differential combined with the bias of the spring 120 produces a downward force on the piston 130 that is greater than the force produced by the pressures (both annular pressure $A_P$ and tubing pressure $T_P$) in the internal flow passage 110. Tubing pressure $T_P$ from the tail port 107 builds in a chamber section 116, and the piston 130 moves to a lower position. Consequently, the indexing assembly 140 is moved into the ratchet profile 118, and the piston's packing seal 135*b* has moved into the throat 115 in the internal flow passage 110. Injected gas can no longer communicate from the side port 114 to the end port 112.

Figure 6C:
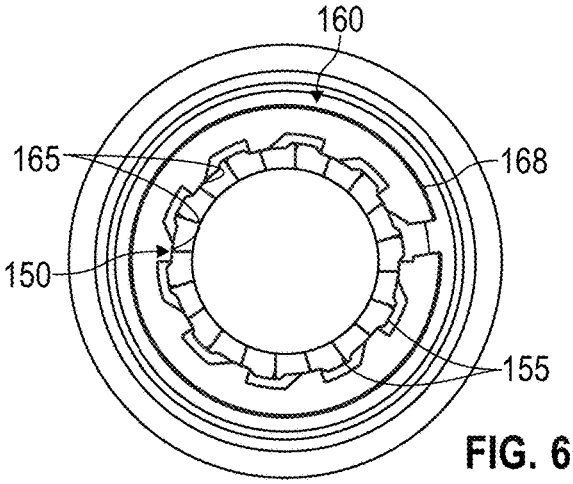
Figure 6A:
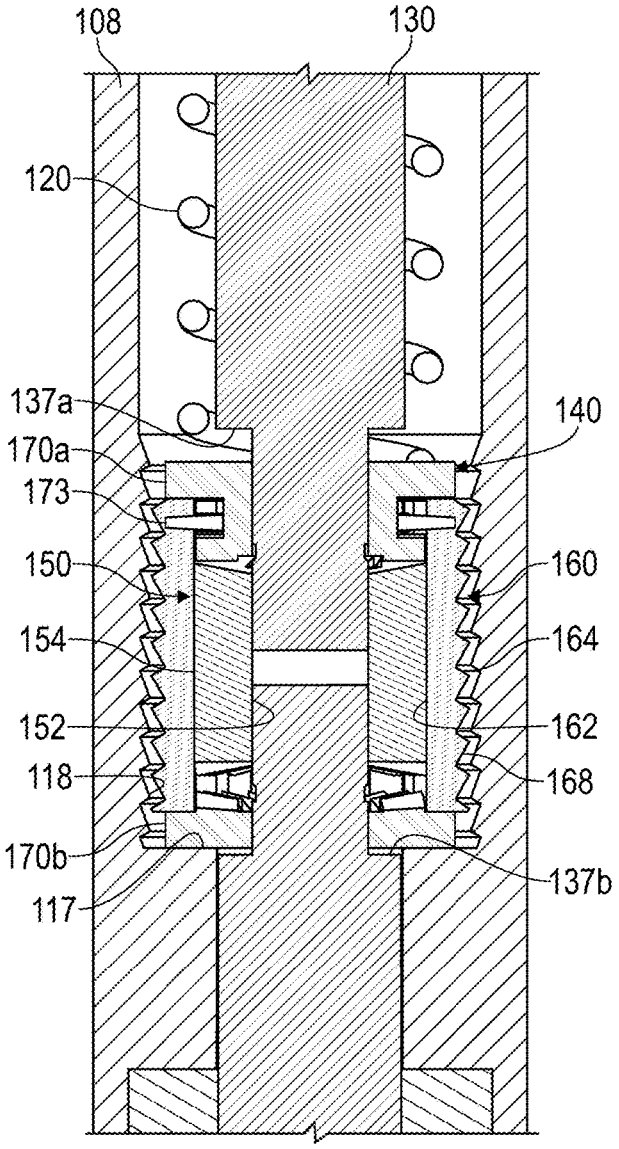
Figure 6B:
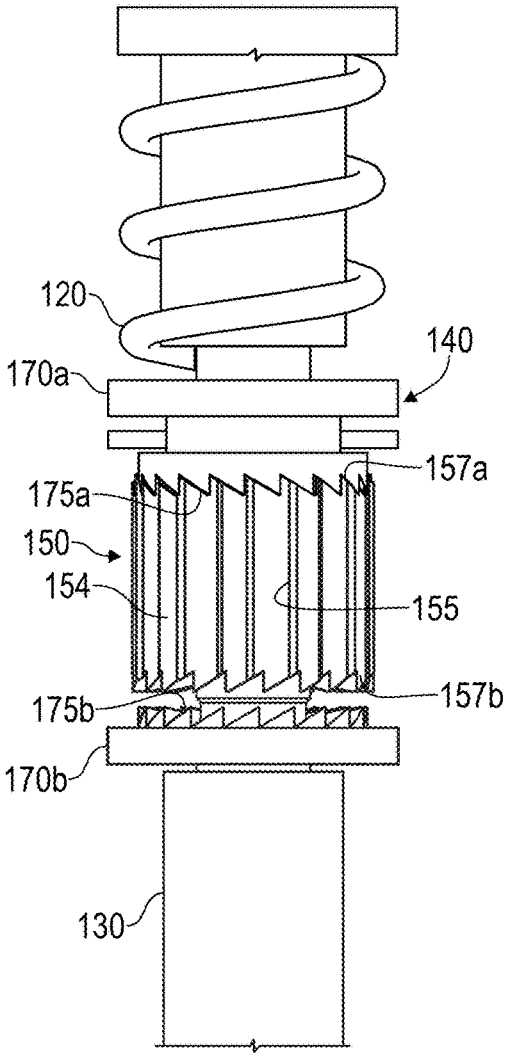

As best shown in the isolated view of FIG. 6B, the pressure differential in this second stage has yet to move the piston 130 and the inner collar 150 enough to disengage the collar's intermediate cam 157*a* from the upper catch ring's cam 175*a*. The inner collar 150 therefore remains engaged with the upper catch ring 170*a* with the intermediate cam 157*a* staying engaged with the upper cam 175*a* on the upper catch ring 170*a*.

As best shown in the plan view of FIG. 6C, the inner longitudinal ridges 165 on the outer collar 160 remain in the slots between the outer longitudinal ridges 155 on the inner collar 150. Consequently, the outer collar 160 remains in its contacted state.

FIGS. 7 and 8A-8C illustrate the indexing assembly 140 in a third stage of operation. In this third stage, the gas lift valve 100 is in a fully closed condition, and the lower annular seal 135*b* is sealed in the throat 115. As best shown in the isolated view of FIG. 8B, the pressure differential in this third stage has now moved the piston 130 and the inner collar 150 enough to disengage the collar's intermediate cam 157*a* from the upper catch ring's cam 175*a*. The lower end 155*b* of the inner collar 150 engages the lower catch ring 170*b*. In the process, the collar's intermediate cams 157*b* engage with the lower cam 175*b*. The offset of the cams 157*b*, 175*b* produces an incremental rotation to the inner collar 150 and the piston 130.

Figure 8C:
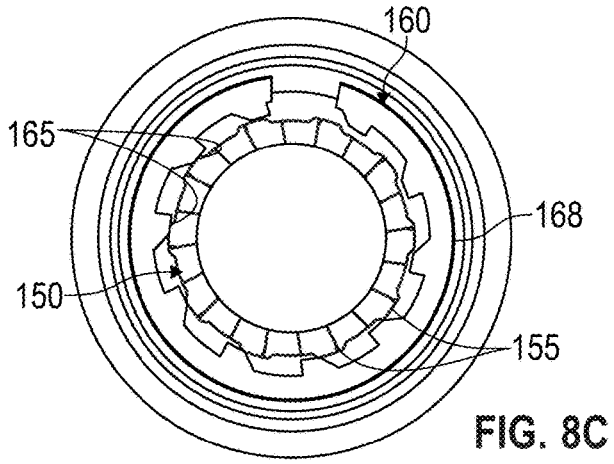

As best shown in the plan view of FIG. 8C, the inner longitudinal ridges 165 on the incrementally rotated outer collar 160 meet with the outer longitudinal ridges 155 on the inner collar 150. Consequently, the outer collar 160 has expanded to its expanded state. (Again, certain components, such as the upper catch ring, pins, etc. are not shown in FIG. 8C so that other components are visible.)

Figure 8A:
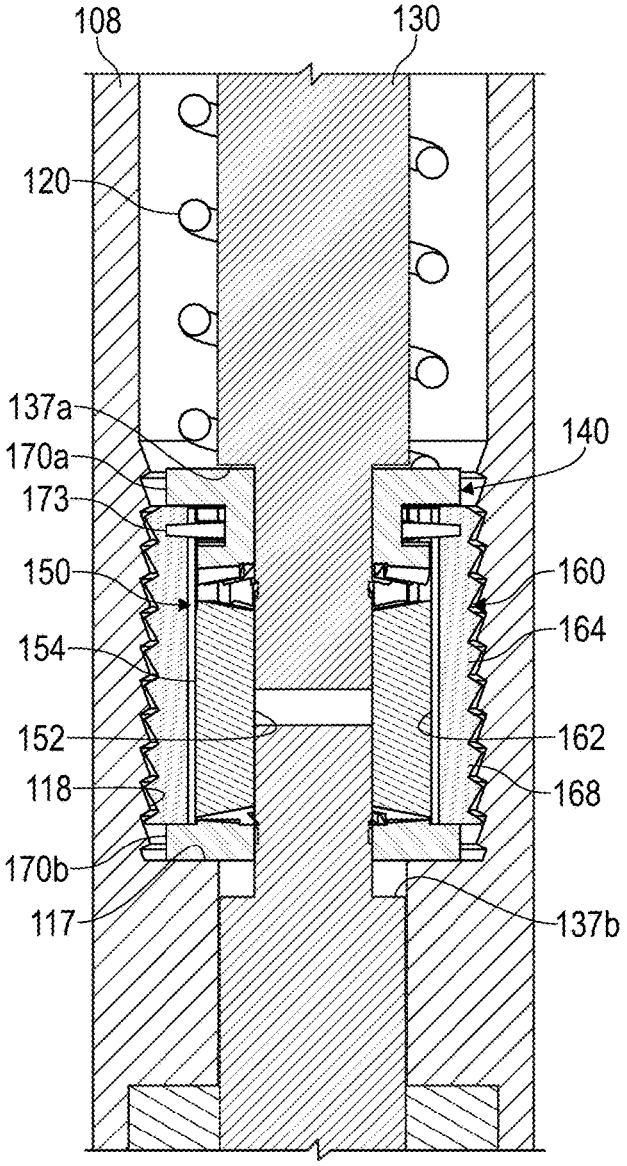
Figure 8B:
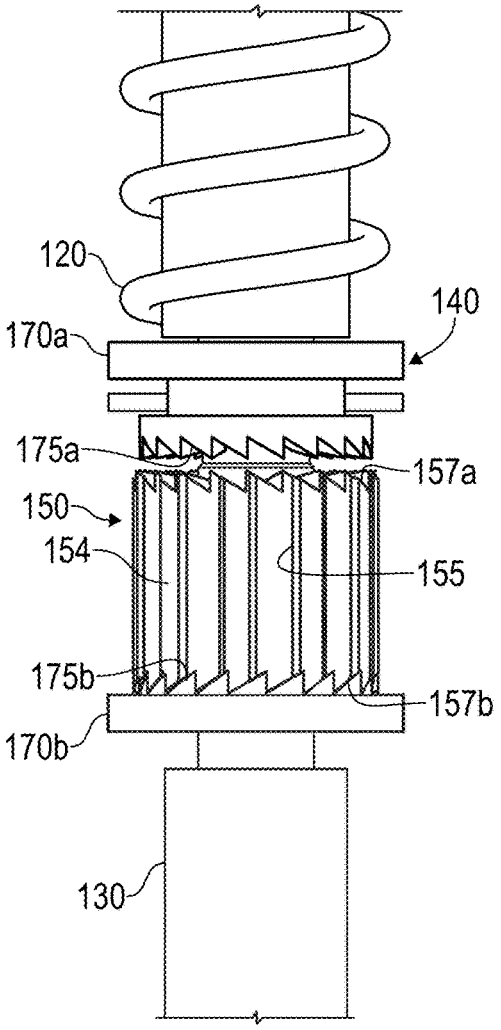

As shown in the detailed cross-section of FIG. 8A, the ridges on the ratchet 168 on the expanded outer collar 160 can engage with the ratchet profile 118 in the internal flow passage 110, preventing upward movement of the piston 130.

The gas lift valve 100 can remain in this fully closed condition as long as desired for this gas lift valve 100. At some point during operations, operators may want to then open the gas lift valve 100 so gas injection can be performed again through the gas lift valve 100.

FIGS. 9 and 10A-10C illustrate the indexing assembly 140 in a fourth stage of operation. In this fourth stage, the gas lift valve 100 is in the process of opening. The tubing pressure $T_P$ at the tail port 107 remains greater than the annulus pressure $A_P$, but the tubing pressure $T_P$ is decreased by a predetermined amount (or the annulus pressure $A_P$ is increased an amount). The piston 130 and the inner collar 150 have been moved slightly upward from its lower position. Consequently, as best shown in the isolated view of FIG. 10B, the upper intermediate cam 157*a* on the inner collar 150 engage with the upper cam 175*a* of the upper catch ring 170*a*. The offset of the cams 157*a*, 175*a* produces another incremental rotation to the inner collar 150 and piston 130.

Figure 10C:
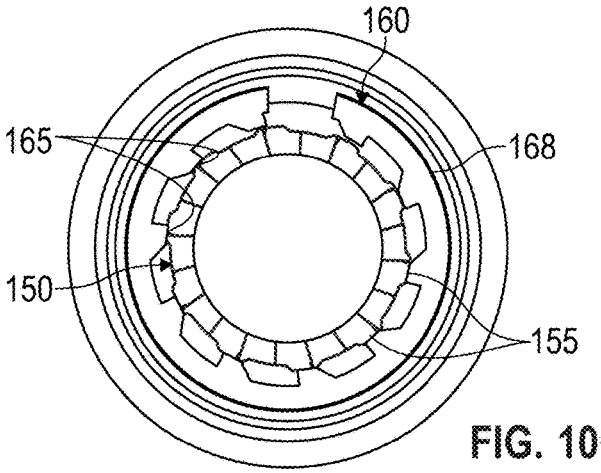
Figure 10A:
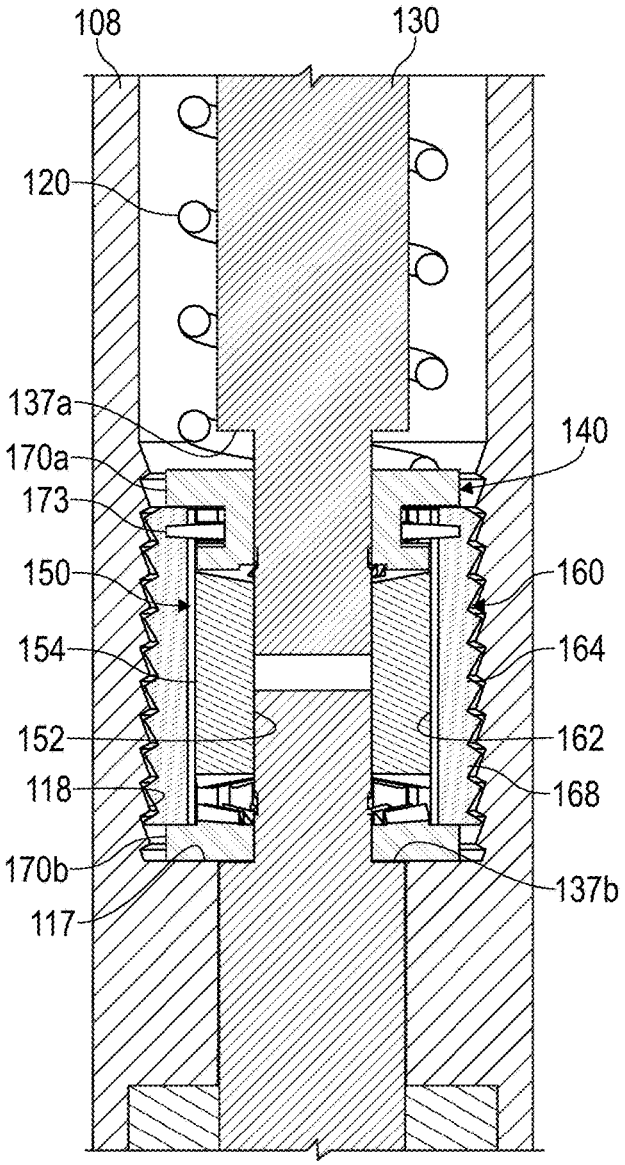
Figure 10B:
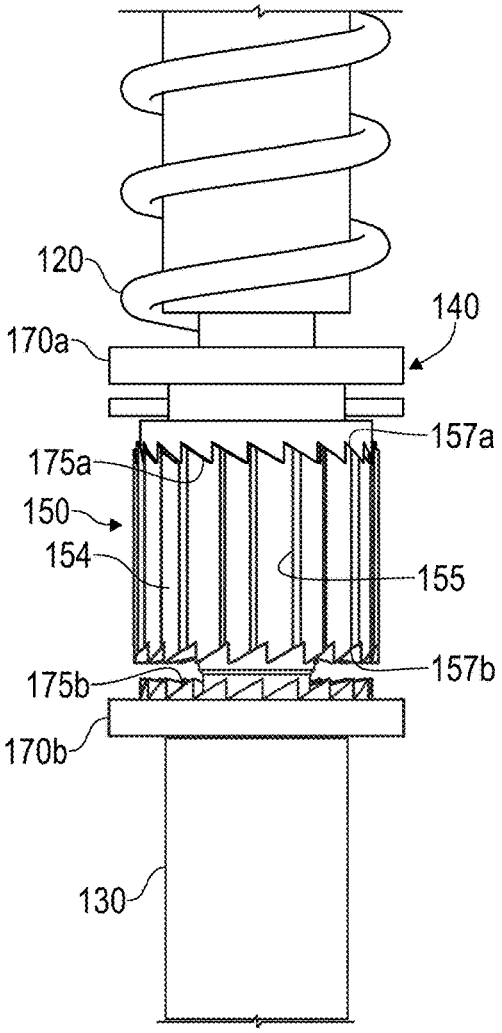
Figure 11:
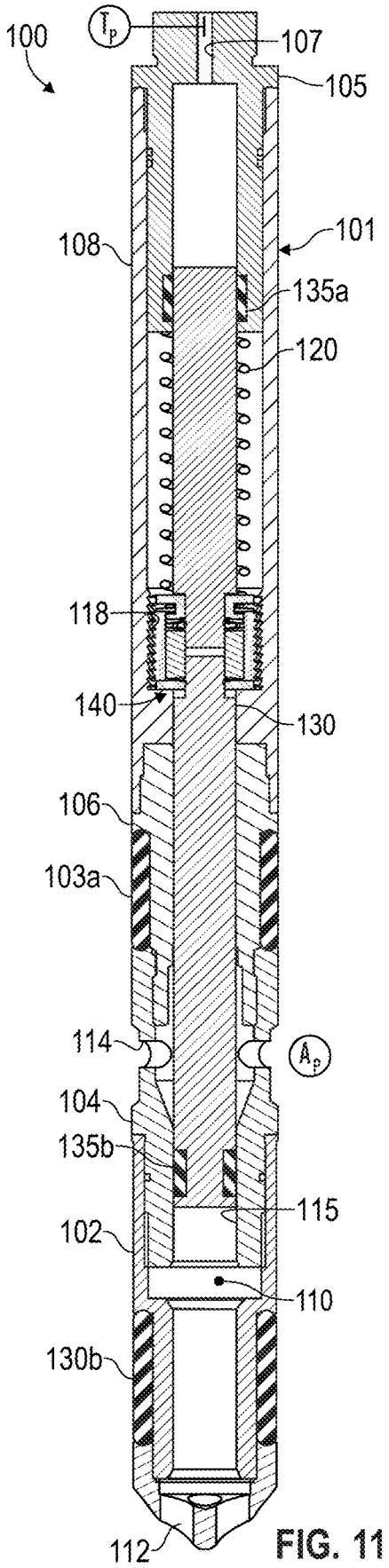
FIGS. 11 and 12A-12C illustrate various views of the indexing assembly in a fifth stage of operation.
Figure 13:
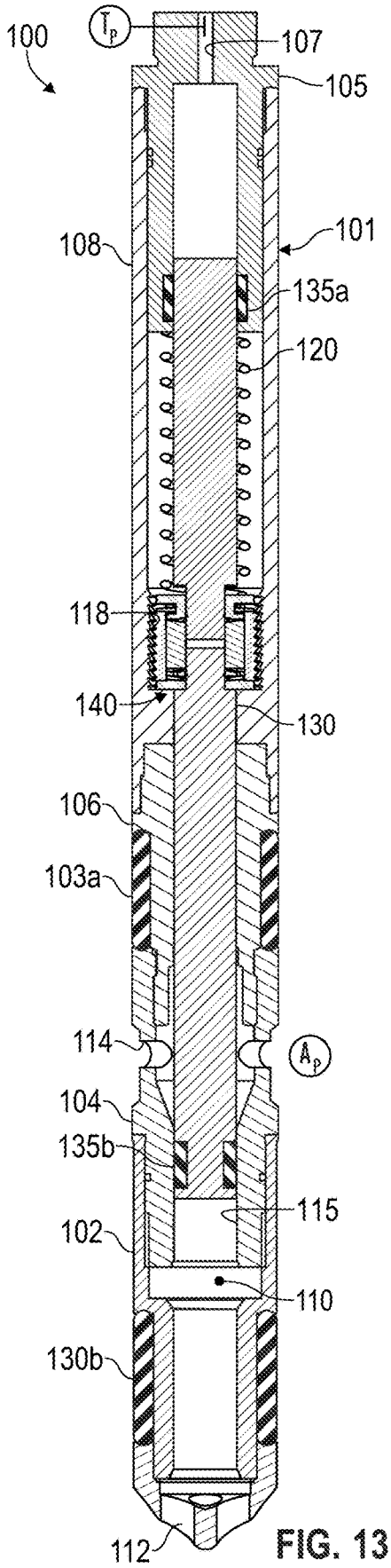
FIGS. 13 and 14A-14C various views of the indexing assembly in a sixth stage of operation.

As best shown in the plan view of FIG. 10C, the outer longitudinal ridges 155 on the inner collar 150 remain engaged with the inner longitudinal ridges 165 on the outer collar 160. Consequently, the outer collar 160 remains in its expanded state. (Again, certain components, such as the upper catch ring, pins, etc. are not shown in FIG. 8C so that other components are visible.)

FIGS. 11 and 12A-12C illustrate the indexing assembly 140 in a fifth stage of operation. In this fifth stage, the gas lift valve 100 is further into the process of opening. The tubing pressure $T_P$ at the tail port 107 remains greater than the annulus pressure $A_P$, but the tubing pressure $T_P$ is increased by a predetermined amount (or the annulus pressure $A_P$ is decreased an amount). The piston 130 and the inner collar 150 have been moved slightly downward. Consequently, as best shown in the isolated view of FIG. 12B, the lower intermediate cams 157*b* on the inner collar 150 engage with the lower cam 175*b* of the lower catch ring 170*b*. The offset of the cams 157*b*, 175*b* produces another incremental rotation to the inner collar 150 and piston 130.

Figure 12C:
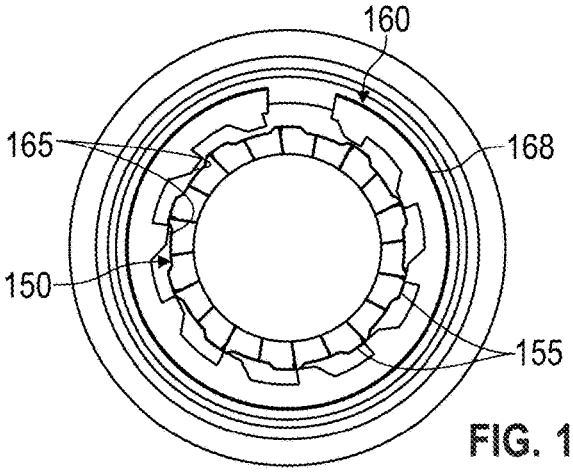
Figure 12A:
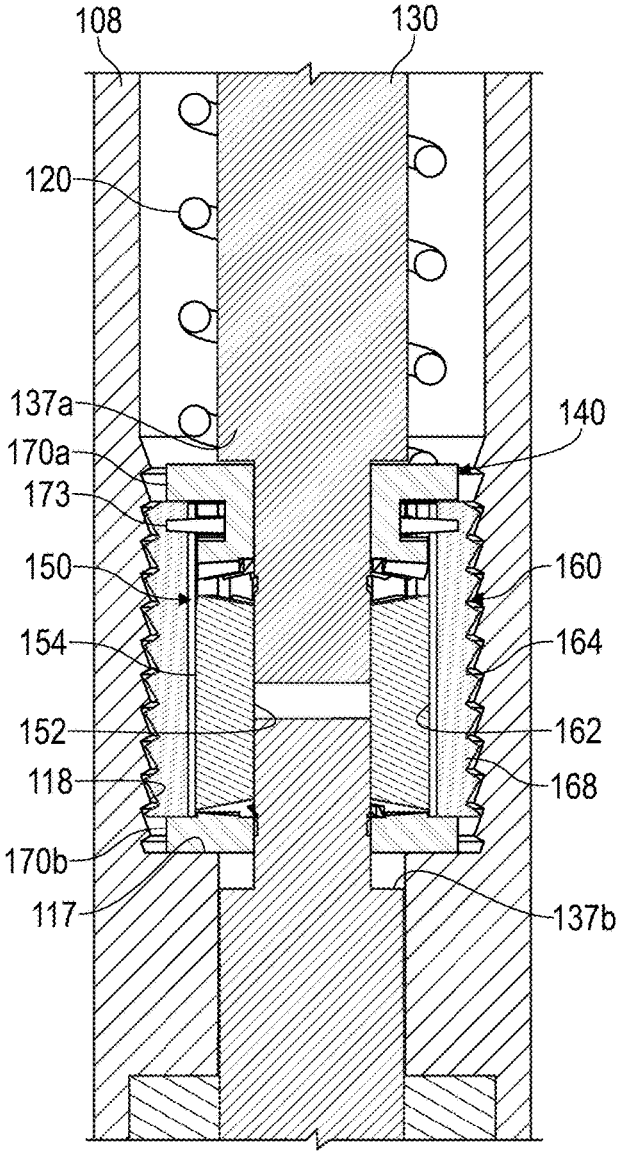
Figure 12B:
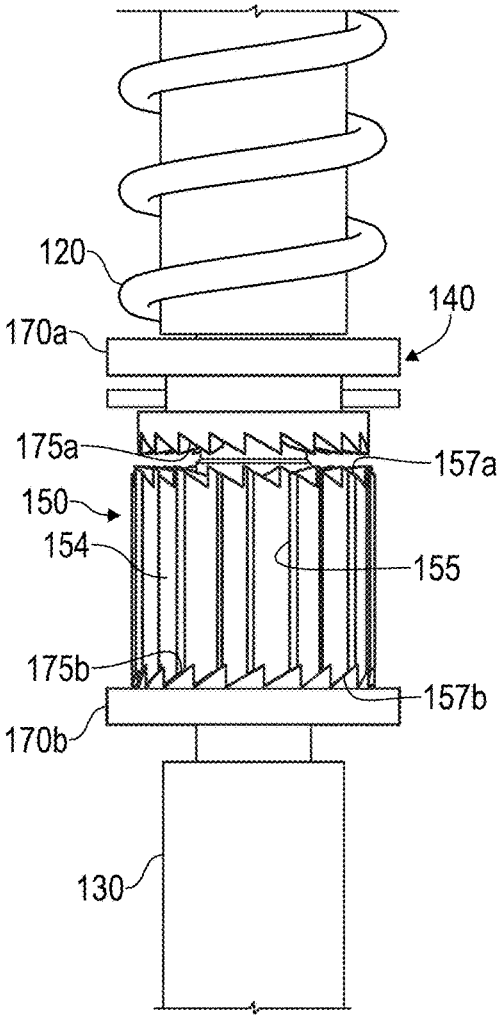

As best shown in the plan view of FIG. 12C, the outer longitudinal ridges 155 on the inner collar 150 start to disengage from the inner longitudinal ridges 165 on the outer collar 160. Consequently, the outer collar 160 can contract towards its contracted state. (Again, certain components, such as the upper catch ring, pins, etc. are not shown in FIG. 12C so that other components are visible.) As shown in the cross-section of FIG. 12A, the ridges on the ratchet 168 on the contract outer collar 160 start to disengage from the ratchet profile 118 in the internal flow passage 110.

FIGS. 13 and 14A-14C illustrate the indexing assembly 140 in a sixth stage of operation. In this sixth stage, the gas lift valve 100 is even further into the process of opening. The tubing pressure $T_P$ at the tail port 107 is decreased (or the annulus pressure $A_P$ at the side port 114 is increased). The piston 130 and the inner collar 150 have been moved upward. Consequently, as best show in the isolated view of FIG. 14B, the upper intermediate cam 157*a* on the inner collar 150 engage with the upper cam 175*a* of the upper catch ring 170*a*. The offset of the cams 157*a*, 175*a* produces yet another incremental rotation to the inner collar 150 and piston 130.

Figure 14C:
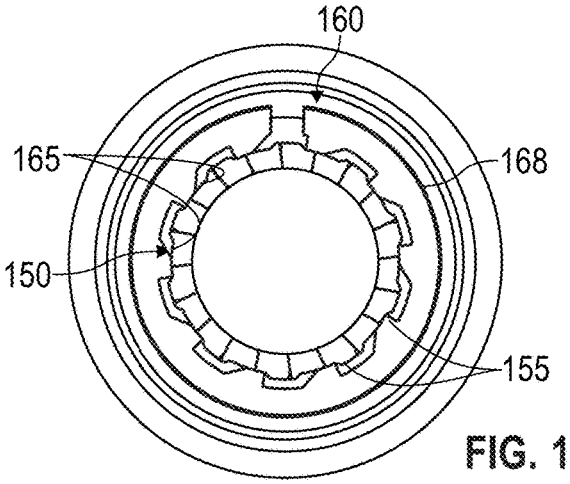

As best shown in the plan view of FIG. 14C, the outer longitudinal ridges 155 on the inner collar 150 disengage from the inner longitudinal ridges 165 on the outer collar 160. Consequently, the outer collar 160 contracts to its contracted state. (Again, certain components, such as the upper catch ring, pins, etc. are not shown in FIG. 4C so that other components are visible.)

Figure 14A:
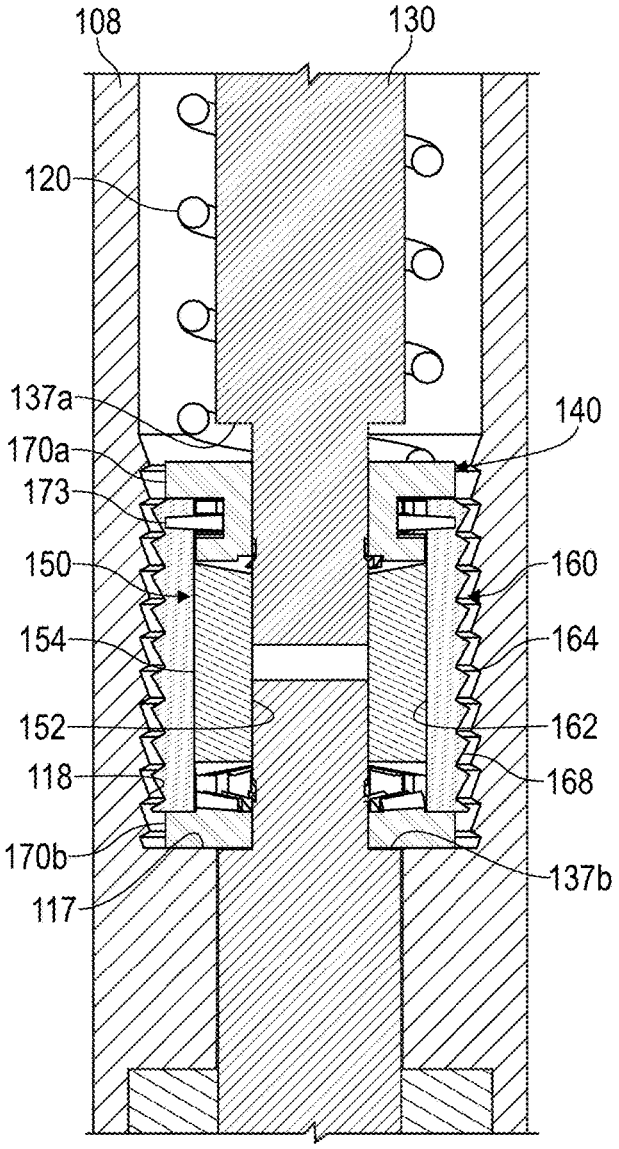
Figure 14B:
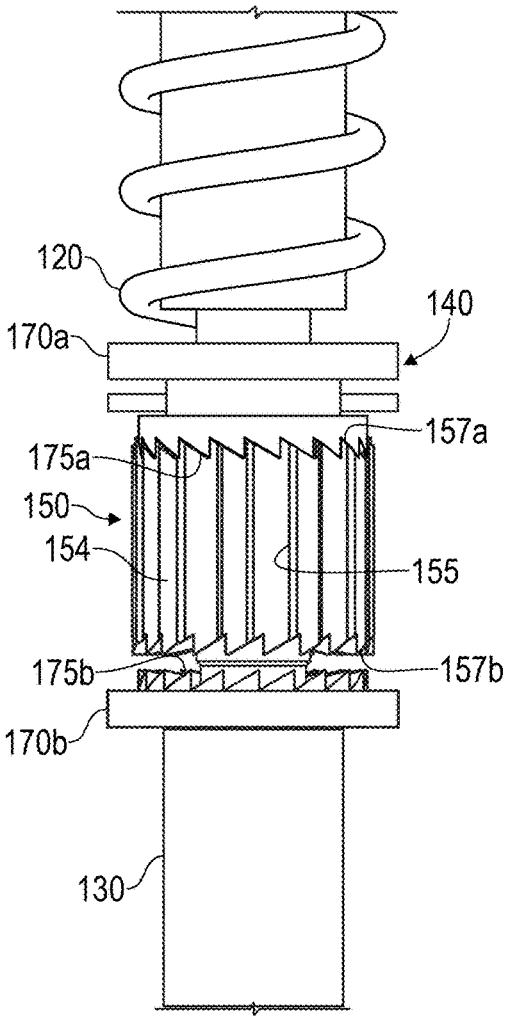

As shown in the cross-section of FIG. 14A, the ridges on the ratchet 168 on the contract outer collar 160 disengage from the ratchet profile 118, allowing the piston 130 to move upward. Eventually, the gas lift valve 100 will reset to its open position as discussed above with reference to FIGS. 3A through 4C. Being reset, the gas lift valve 100 can then be cycled again any number of times as desired during operations between the open and closed states.

As can be seen, the indexing assembly 140 uses axial movement caused by the pressure differentials to induce rotation of the inner cam 141 (inner collar 150) to alternately expand and contract the outer cam 142 (outer collar 160). The alternating expansion and contraction of the outer cam 142 (outer collar 160) allows for alternating engagement and disengagement with the internal ratchet profile 118 of the housing 101, which in turn alternatingly allows or prevents movement of the piston 130 to control fluid communication through the gas lift valve 100.

The indexing assembly 140 contains an outer collar 160 containing internal grooves, ridges 165 rotationally locked with catch rings 170*a-b* on both ends. These catch rings 170*a-b* have ends 174*a-b* with cams or teeth 175*a-b* out of phase with each other. The outer collar 160 is positioned around an inner collar 150 on a piston 130, which is able to close off or allow fluid flow through the gas lift valve 100 from the annulus to the tubing. The inner collar 150 has: (i) ridges 165 that interact with the internal grooves and ridges 155 of the outer collar 160, and (ii) cams or teeth 167*a-b* that interact with the teeth 175*a-b* on the catch rings 170*a-b*. As the piston 130 moves axially due to the pressure differential, the teeth 175*a-b* on the catch rings 170*a-b* cause the piston 130 and inner collar 150 to rotate. As the piston 130 and inner collar 150 rotate, the ridges 155 interact with the grooves/ridges 165 on the outer collar 160, causing the outer collar 160 to either expand or contract. When expanded, ratchet 168 on the outer collar 160 interacts with the ratchet profile 118 in the housing to prevent axial movement of the piston 130 at least toward its open position. Repetition of the pressure cycling between the tubing and annulus pressures will cause the piston 130 to be held in a closed position or allowed to move to an open position for communication.

By using the inner collar 150 and the outer collar 160, the indexing assembly 140 may require only a small amount of axial movement to index and rotate the inner collar 150 relative to the outer collar 160. The reduced movement can be helpful when the gas lift valve 100 is used in a mandrel that has redundant sealing mechanisms, such as a DVX style mandrel available from Weatherford.

As noted above, the indexing assembly 140 can use cams 141, 142 having ramped teeth to produce the rotation of the inner collar 150 that changes the alignment of the ridges to expand/contract the outer collar 160. Other indexing arrangements can be used for the indexing assembly 140.

Figure 19B:
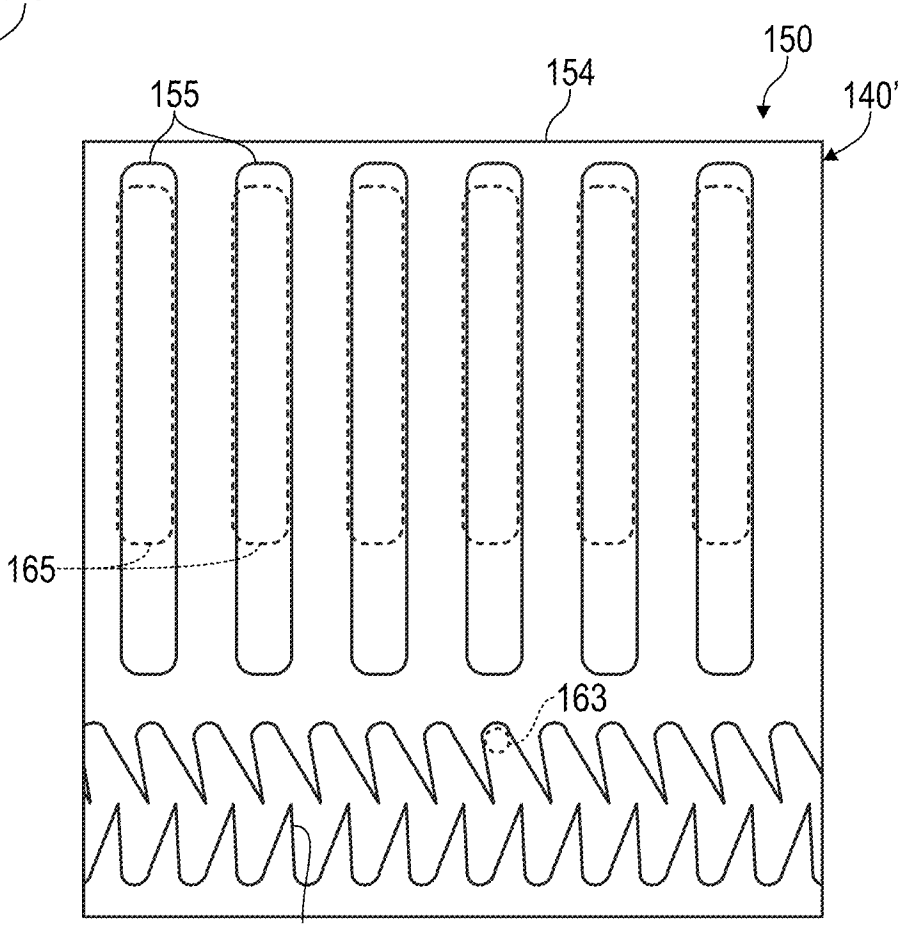
FIGS. 19A-19B schematically illustrate another cam arrangement for the indexing assembly.
Figure 19A:
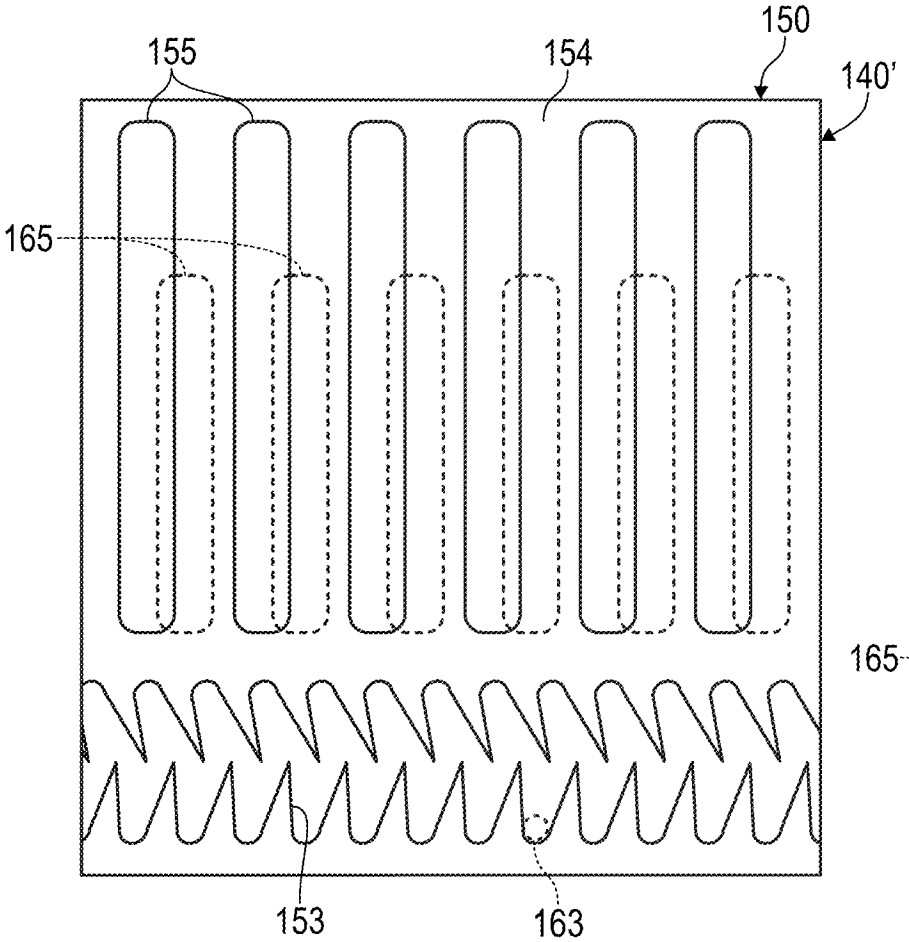

As one example, FIGS. 19A-19B schematically illustrate an indexing assembly 140' having another indexing arrangement. FIG. 19A shows the circumference of the outer surface 154 of the inner collar (150) schematically rolled out. The outer surface 154 has the outer longitudinal ridges 155 and defines a continuous slot 153 as part of a first cam. The continuous slot 153 is defined about the circumference of the outer surface and has upper and lower resting positions offset from one another.

For the outer collar (160), only the inner longitudinal ridges 165 and a pin 163 as part of a second cam are shown. For stability, more than one pin 163 can be used for the second cam. Because the outer collar (160) is a split ring or a C-ring, the pin 163 can be positioned opposite the split, which is not shown. Instead of a C-ring, the outer collar (160) can include segments or the like that can contract or expand relative to one another. Each segment can have its own pin 163 and one or more of the longitudinal ridges 165.

As the inner collar (150) is moved between an upward position (FIG. 19A) and a downward position (FIG. 19B) relative to the outer collar (160) in response to the pressure differentials as discussed previously, the pin 163 on the outer collar (160) rides in the continuous slot 153 of the inner collar (150), causing the inner collar (150) to rotate and shifting the alignment of the longitudinal ridges 155, 165. Thus, as described previously, when the inner and outer longitudinal ridges 155, 165 are aligned as in FIG. 19B, the outer collar (160) is expanded to engage with the ratchet profile (118).

Configurations of the present disclosure can be characterized as follows:

1. A gas lift valve comprising:

a housing (101) defining an internal passage (110) having a first port (114), a second port (107), and a third port (112), the first port (114) being exposed to an annulus pressure, the second port (107) being exposed to a tubing pressure, the third port (112) being configured to at least communicate outside the housing (101), a portion of the internal passage (110) defining a catch profile (118) disposed thereabout;

a piston (130) disposed in the internal passage (110), the piston (130) being movable in first and second axial directions with axial movement between first and second positions in the internal passage (110) at least in response to a pressure differential between the first and second ports (114, 107), the piston (130) in the first and second positions being configured to at least control fluid communication between the first port (114) and the third port (112); and an indexing assembly (140) having first and second cams (141, 142), the first cam (141) disposed on the piston (130), the second cam (142) disposed relative to the first cam (141), the first cam (141) and the piston (130) in the second position being rotatably indexed in incremental rotations relative to the second cam (142) in response to the axial movement alternatingly in the first and second axial directions, the second cam (142) being configured to alternatingly engage and disengage with the catch profile (118) in response to the incremental rotations of the first cam (141), the second cam (142) engaged with the catch profile (118) being configured to prevent the axial movement of the piston (130) in the first axial direction, the second cam (142) disengaged with the catch profile (118) being configured to permit the axial movement of the piston (130) in the first axial direction.

2. The gas lift valve of Clause 1, wherein the first port (114) is disposed in communication with the annulus pressure on a first sealed side of the piston (130); wherein the second port (107) is disposed in communication with the tubing pressure on a second sealed side of the piston (130) opposite to the first seal side; and wherein the third port (112) is disposed in communication with the tubing pressure on the first sealed side of the piston (130).

3. The gas lift valve of Clause 2, wherein the first port (114) comprises a side port (114) defined in a side of the housing (101); wherein the second port (107) defines a tail port (107) defined in a tail of the housing (101); and wherein the third port (112) defines an end port (112) defined in an end of the housing (101).

4. The gas lift valve of Clause 1, 2 or 3, comprising a check valve (119) disposed in the internal passage (110), the check valve (119) permitting fluid communication from the internal passage (110) to the third port (112) and preventing fluid communication from the third port (112) to the internal passage (110).

5. The gas lift valve of any one of Clauses 1 to 4, wherein the piston (130) in the first position opens communication between the first port (114) and the third port (112); and wherein the piston (130) in the second position closes communication between the first port (114) and the third port (112).

6. The gas lift valve of any one of Clauses 1 to 5, wherein the second cam (142) is configured to alternatingly expand and contract in an expanded state and a contracted state in response to the incremental rotations of the first cam (141), the second cam (142) in the expanded state on the piston (130) in the second position being configured to engage with the catch profile (118) and being configured to prevent the axial movement of the piston (130) in the first axial direction, the second cam (142) in the contracted state on the piston (130) in the second position being configured to be disengaged with the catch profile (118) and being configured to permit the axial movement of the piston (130) in the first axial direction.

7. The gas lift valve of Clause 6, wherein the first cam (141) comprises an intermediate outer surface (154) disposed on the piston (130) and having outer longitudinal ridges (155) disposed thereabout, the intermediate outer surface (154) and the piston (130) being rotatably indexed in the incremental rotations in response to the axial movement of the piston (130) alternatingly in the first and second axial directions; and wherein the second cam (142) comprises an outer collar (160) disposed about the intermediate outer surface (154) and being expandable and contractable, the outer collar (160) having an inner surface (162) and an outer surface (164), the inner surface (162) having inner longitudinal ridges (165) disposed thereabout, the outer surface (164) having an outer circumferential catch (168) disposed thereabout.

8. The gas lift valve of Clause 7, wherein the incremental rotations of the intermediate outer surface (154) are configured to alternately expand and contract the outer collar (160) in the expanded and contracted states in response to the outer longitudinal ridges (155) of the intermediate outer surface (154) being alternately engaged and disengaged with the inner longitudinal ridges (165) of the outer collar (160).

9. The gas lift valve of Clause 8, wherein the outer circumferential catch (168) on the outer collar (160) in the expanded state is configured to engage with the catch profile (118) and is configured to prevent the axial movement of the piston (130) in the second axial direction; and wherein the outer circumferential catch (168) on the outer collar (160) in the contracted state is configured to disengage with the catch profile (118) and is configured to allow the axial movement of the piston (130) in the second axial direction.

10. The gas lift valve of Clauses 7, 8 or 9, wherein the second cam (142) comprises: a first ring (170*a*) disposed on the piston (130) and having a first cam surface (174*a*); and a second ring (170*b*) disposed on the piston (130) and having a second cam surface (174*b*), the first and second cam surfaces (174*a-b*) having an offset from one another, the outer collar (160) disposed between the first and second rings (170*a-b*), the first ring (170*a*), the second ring (170*b*), and the outer collar (160) are axially aligned with each other and are isolated from the incremental rotations of the piston (130); and wherein the first cam (141) comprises an inner collar (150) attached to the piston (130) and disposed inside the outer collar (160), the inner collar (150) having the intermediate outer surface (154) and having first and second intermediate cam surfaces (156*a-b*), the first and second intermediate cam surfaces (156*a-b*) spaced between the first and second rings (170*a-b*), the intermediate outer surface (154) having the outer longitudinal ridges (155) disposed thereabout, the first and second intermediate cam surfaces (156*a-b*) being configured to alternately engage the first and second cam surfaces (174*a-b*), the offset of the first and second cam surfaces (174*a-b*) being configured to rotate the piston (130) and the inner collar (150) in the incremental rotations in response to the first and second intermediate cam surfaces (156*a-b*) alternatingly engaged with the first and second cam surfaces (174*a-b*).

11. The gas lift valve of any one of Clauses 7 to 10, wherein the intermediate outer surface (154) has a slot profile (153) having upper and lower positions offset from one another; and wherein the inner surface (162) of the outer collar (160) has at least one pin (163) disposed in the slot profile (153), the at least one pin (163) being configured to move in the slot profile (153) alternating between the first and second positions.

12. The gas lift valve of any one of Clauses 1 to 6 wherein the second cam (142) comprises:

a first ring (170*a*) disposed on the piston (130) and having a first cam surface (174*a*);

a second ring (170*b*) disposed on the piston (130) and having a second cam surface (174*b*), the first and second cam surfaces (174*a-b*) having an offset from one another;

wherein the first cam (141) comprises an inner collar (150) attached to the piston (130), the inner collar (150) having an intermediate outer surface (154) and having first and second intermediate cam surfaces (156*a-b*), the first and second intermediate cam surfaces (156*a-b*) spaced between the first and second rings (170*a-b*), the intermediate outer surface (154) having outer longitudinal ridges (155) disposed thereabout; and wherein the second cam (142) comprises an outer collar (160) disposed about the inner collar (150) and being expandable and contractable, the outer collar (160) having an inner surface (162) and an outer surface (164), the inner surface (162) having internal longitudinal ridges (165) disposed thereabout, the outer surface (164) having an outer circumferential ratchet (168) disposed thereabout, the first and second intermediate cam surfaces (156*a-b*) being configured to alternately engage the first and second cam surfaces (174*a-b*), the offset of the first and second cam surfaces (174*a-b*) being configured to rotate the piston (130) and the inner collar (150) in incremental rotations in response to the first and second intermediate cam surfaces (156*a-b*) alternatingly engaged with the first and second cam surfaces (174*a-b*), the incremental rotations of the inner collar (150) being configured to alternatingly expand and contract the outer collar (160) in an expanded state and a contracted state in response to the outer longitudinal ridges (155) of the inner collar (150) engaged and disengaged with the inner longitudinal ridges (165) of the outer collar (160), the outer circumferential ratchet (168) on the outer collar (160) in the expanded state on the piston (130) in the second position being configured to engage with the ratchet profile (118) and being configured to prevent the axial movement of the piston (130) in the first axial direction, the outer circumferential ratchet (168) on the outer collar (160) in the contracted state on the piston (130) in the second position being configured to disengage with the ratchet profile and being configured to allow the axial movement of the piston (130) in the first axial direction.

13. The gas lift valve of Clause 12, wherein the first cam surface (174*a*) and the first intermediate cam surface (156*a*) define first complementary ramped teeth (175*a*, 157*a*) oriented in a first direction; and wherein the second cam surface (174*b*) and the second intermediate cam surface (156*b*) define second complementary ramped teeth (175*b*, 157*b*) oriented in a second direction opposite to the first direction.

14. The gas lift valve of Clause 12 or 13, wherein the piston (130) defines a first shoulder (137*a*) and a second shoulder (137*b*), the first and second rings (170*a-b*) being spaced between the first and second shoulders (137*a-b*), the first and second rings (170*a-b*) and the outer collar (160) being axially movable on the piston (130) between the first and second shoulders (137*a-b*);

wherein the gas lift valve further comprises a biasing element (120) biasing between a first surface in the internal passage (110) and the first ring (170*a*) on the piston (130);

wherein the internal passage (110) defines a second surface (117) opposite to the first surface, the second ring (170*b*) being configured to engage the second surface (117) in response to the piston (130) moved in the second axial direction; and wherein the ratchet profile (118) is defined in the internal passage (110) adjacent to the second surface (117);

wherein the outer circumferential ratchet (168) is configured to ratchet past the ratchet profile (118) in response to the axial movement of the piston (130) in the second axial direction;

wherein the outer collar (160) comprises a sleeve defining a longitudinal split (161);

wherein a distal end of the piston (130) is movable relative to a throat (115) in the internal passage (110) between the first port (114) and the third port (112), the distal end having an annular seal (135*b*) configured to seal in the throat (115); and/or wherein the gas lift valve comprises pins (173) engaged between the first ring (170*a*) and the outer collar (160).

15. A method used for a gas lift completion in a wellbore, the method comprising:

at least controlling fluid communication through a gas lift valve (101) by:

producing pressure differentials in an internal passage (110) of the gas lift valve (101) between an annulus pressure of the wellbore and a tubing pressure of the gas lift completion; and alternatingly moving a pressure-sensitive piston (130) in first and second axial directions with axial movement between first and second positions in the gas lift valve (101) in response to the pressure differentials;

holding and releasing the pressure-sensitive piston (130) at least in the second position by:

rotatably indexing an indexing assembly (140) in incremental rotations in response to the axial movement of the pressure-sensitive piston (130) in the second position alternatingly in the first and second axial directions; and alternatingly expanding and contracting an outer circumferential ratchet (168) in expanded and contracted states in response to the incremental rotations of the indexing assembly (140) on the pressure-sensitive piston (130) in the second position; and alternatingly preventing and allowing the axial movement of the pressure-sensitive piston (130) in the first axial direction from the second position by alternatingly engaging and disengaging the outer circumferential ratchet (168) in response to the expanded and contracted states with a ratchet profile (118) defined in the internal passage (110).

The gas lift valve and its components can be situated in any orientation. Terms, such as "upper," "lower," "upward," "downward," "inner," "outer," etc., are merely used as a frame of reference to improve understanding and are not limiting to the disclosed arrangements.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

The invention claimed is:

1. A gas lift valve comprising:

a housing defining an internal passage having a first port, a second port, and a third port, the first port being exposed to an annulus pressure, the second port being exposed to a tubing pressure, the third port being configured to at least communicate outside the housing, a portion of the internal passage defining a catch profile disposed thereabout;

a piston disposed in the internal passage, the piston being movable in first and second axial directions with axial movement between first and second positions in the internal passage at least in response to a pressure differential between the first and second ports, the piston in the first and second positions being configured to at least control fluid communication between the first port and the third port; and an indexing assembly having first and second cams, the first cam disposed on the piston, the second cam disposed relative to the first cam, the first cam and the piston in the second position being rotatably indexed in incremental rotations relative to the second cam in response to the axial movement alternatingly in the first and second axial directions, the second cam being configured to alternatingly engage and disengage with the catch profile in response to the incremental rotations of the first cam, the second cam engaged with the catch profile being configured to prevent the axial movement of the piston in the first axial direction, the second cam disengaged with the catch profile being configured to permit the axial movement of the piston in the first axial direction.

2. The gas lift valve of claim 1, wherein the first port is disposed in communication with the annulus pressure on a first sealed side of the piston; wherein the second port is disposed in communication with the tubing pressure on a second sealed side of the piston opposite to the first seal side; and wherein the third port is disposed in communication with the tubing pressure on the first sealed side of the piston.

3. The gas lift valve of claim 2, wherein the first port comprises a side port defined in a side of the housing; wherein the second port defines a tail port defined in a tail of the housing; and wherein the third port defines an end port defined in an end of the housing.

4. The gas lift valve of claim 1, comprising a check valve disposed in the internal passage, the check valve permitting fluid communication from the internal passage to the third port and preventing fluid communication from the third port to the internal passage.

5. The gas lift valve of claim 1, wherein the piston in the first position opens communication between the first port and the third port; and wherein the piston in the second position closes communication between the first port and the third port.

6. The gas lift valve of claim 1, wherein the second cam is configured to alternatingly expand and contract in an expanded state and a contracted state in response to the incremental rotations of the first cam, the second cam in the expanded state on the piston in the second position being configured to engage with the catch profile and being configured to prevent the axial movement of the piston in the first axial direction, the second cam in the contracted state on the piston in the second position being configured to be disengaged with the catch profile and being configured to permit the axial movement of the piston in the first axial direction.

7. The gas lift valve of claim 6, wherein the first cam comprises an intermediate outer surface disposed on the piston and having outer longitudinal ridges disposed thereabout, the intermediate outer surface and the piston being rotatably indexed in the incremental rotations in response to the axial movement of the piston alternatingly in the first and second axial directions; and wherein the second cam comprises an outer collar disposed about the intermediate outer surface and being expandable and contractable, the outer collar having an inner surface and an outer surface, the inner surface having inner longitudinal ridges disposed thereabout, the outer surface having an outer circumferential catch disposed thereabout.

8. The gas lift valve of claim 7, wherein the incremental rotations of the intermediate outer surface are configured to alternately expand and contract the outer collar in the expanded and contracted states in response to the outer longitudinal ridges of the intermediate outer surface being alternately engaged and disengaged with the inner longitudinal ridges of the outer collar.

9. The gas lift valve of claim 8, wherein the outer circumferential catch on the outer collar in the expanded state is configured to engage with the catch profile and is configured to prevent the axial movement of the piston in the second axial direction; and wherein the outer circumferential catch on the outer collar in the contracted state is configured to disengage with the catch profile and is configured to allow the axial movement of the piston in the second axial direction.

10. The gas lift valve of claim 7, wherein the second cam comprises:

a first ring disposed on the piston and having a first cam surface; and a second ring disposed on the piston and having a second cam surface, the first and second cam surfaces having an offset from one another, the outer collar disposed between the first and second rings, the first ring, the second ring, and the outer collar are axially aligned with each other and are isolated from the incremental rotations of the piston; and wherein the first cam comprises an inner collar attached to the piston and disposed inside the outer collar, the inner collar having the intermediate outer surface and having first and second intermediate cam surfaces, the first and second intermediate cam surfaces spaced between the first and second rings, the intermediate outer surface having the outer longitudinal ridges disposed therebout, the first and second intermediate cam surfaces being configured to alternately engage the first and second cam surfaces, the offset of the first and second cam surfaces being configured to rotate the piston and the inner collar in the incremental rotations in response to the first and second intermediate cam surfaces alternatingly engaged with the first and second cam surfaces.

11. The gas lift valve of claim 7, wherein the intermediate outer surface has a slot profile having upper and lower positions offset from one another; and wherein the inner surface of the outer collar has at least one pin disposed in the slot profile, the at least one pin being configured to move in the slot profile alternating between the first and second positions.

12. A gas lift valve comprising:

a housing defining an internal passage having a first port, a second port, and a third port, the first port exposed to an annulus pressure, the second port exposed to a tubing pressure, the third port being configured to at least communicate outside the housing, a portion of the internal passage defining a ratchet profile disposed thereabout;

a piston sealed in the internal passage, the piston being movable in first and second axial directions with axial movement between first and second positions in the internal passage at least in response to a pressure differential between the first and second ports, the piston in the first position permitting communication between the first port and the third port, the piston in the second position restricting communication between the first port and the third port; and an indexing assembly disposed on the piston and comprising:

a first ring disposed on the piston and having a first cam surface;

a second ring disposed on the piston and having a second cam surface, the first and second cam surfaces having an offset from one another;

an inner collar attached to the piston, the inner collar having an intermediate outer surface and having first and second intermediate cam surfaces, the first and second intermediate cam surfaces spaced between the first and second rings, the intermediate outer surface having outer longitudinal ridges disposed therebout; and an outer collar disposed about the inner collar and being expandable and contractable, the outer collar having an inner surface and an outer surface, the inner surface having inner longitudinal ridges disposed thereabout, the outer surface having an outer circumferential ratchet disposed thereabout, the first and second intermediate cam surfaces being configured to alternately engage the first and second cam surfaces, the offset of the first and second cam surfaces being configured to rotate the piston and the inner collar in incremental rotations in response to the first and second intermediate cam surfaces alternatingly engaged with the first and second cam surfaces, the incremental rotations of the inner collar being configured to alternatingly expand and contract the outer collar in an expanded state and a contracted state in response to the outer longitudinal ridges of the inner collar engaged and disengaged with the inner longitudinal ridges of the outer collar, the outer circumferential ratchet on the outer collar in the expanded state on the piston in the second position being configured to engage with the ratchet profile and being configured to prevent the axial movement of the piston in the first axial direction, the outer circumferential ratchet on the outer collar in the contracted state on the piston in the second position being configured to disengage with the ratchet profile and being configured to allow the axial movement of the piston in the first axial direction.

13. The gas lift valve of claim 12, wherein the first cam surface and the first intermediate cam surface defines first complementary ramped teeth oriented in a first direction; and wherein the second cam surface and the second intermediate cam surface defines second complementary ramped teeth oriented in a second direction opposite to the first direction.

14. The gas lift valve of claim 12, wherein the piston defines a first shoulder and a second shoulder, the first and second rings being spaced between the first and second shoulders, the first and second rings and the outer collar being axially movable on the piston between the first and second shoulders.

15. The gas lift valve of claim 12, further comprising a biasing element biasing between a first surface in the internal passage and the first ring on the piston.

16. The gas lift valve of claim 12, wherein the outer circumferential ratchet is configured to ratchet past the ratchet profile in response to the axial movement of the piston in the second axial direction.

17. The gas lift valve of claim 12, wherein the outer collar comprises a sleeve defining a longitudinal split.

18. The gas lift valve of claim 12, wherein a distal end of the piston is movable relative to a throat in the internal passage between the first port and the third port, the distal end having an annular seal configured to seal in the throat.

19. The gas lift valve of claim 12, comprising pins engaged between the first ring and the outer collar.

20. A method used for a gas lift completion in a wellbore, the method comprising:

at least controlling fluid communication through a gas lift valve by:

producing pressure differentials in an internal passage of the gas lift valve between an annulus pressure of the wellbore and a tubing pressure of the gas lift completion; and alternatingly moving a pressure-sensitive piston in first and second axial directions with axial movement between first and second positions in the gas lift valve in response to the pressure differentials;

holding and releasing the pressure-sensitive piston at least in the second position by:

rotatably indexing an indexing assembly in incremental rotations in response to the axial movement of the pressure-sensitive piston in the second position alternatingly in the first and second axial directions; and alternatingly expanding and contracting an outer circumferential ratchet in expanded and contracted states in response to the incremental rotations of the indexing assembly on the pressure-sensitive piston in the second position; and alternatingly preventing and allowing the axial movement of the pressure-sensitive piston in the first axial direction from the second position by alternatingly engaging and disengaging the outer circumferential ratchet in response to the expanded and contracted states with a ratchet profile defined in the internal passage.

* * * * *